US011370228B2

(12) United States Patent
Uehira

(10) Patent No.: US 11,370,228 B2
(45) Date of Patent: Jun. 28, 2022

(54) IMAGE RECORDING APPARATUS, OUTPUT CONTROL METHOD, AND STORAGE MEDIUM

(71) Applicant: Masataka Uehira, Tokyo (JP)

(72) Inventor: Masataka Uehira, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/953,905

(22) Filed: Nov. 20, 2020

(65) Prior Publication Data

US 2021/0162773 A1 Jun. 3, 2021

(30) Foreign Application Priority Data

Nov. 28, 2019 (JP) ..... JP2019-215414

(51) Int. Cl.
*B41J 2/47* (2006.01)
*B41J 3/28* (2006.01)

(52) U.S. Cl.
CPC ..... *B41J 2/47* (2013.01); *B41J 3/286* (2013.01)

(58) Field of Classification Search
CPC ..... B41J 2/47; B41J 3/286
See application file for complete search history.

(56) References Cited

U.S. PATENT DOCUMENTS

| | | | |
|---|---|---|---|
| 9,987,856 B2 | 6/2018 | Sawamura et al. | |
| 10,148,064 B2 | 12/2018 | Sakai et al. | |
| 2018/0333964 A1 | 11/2018 | Sawamura et al. | |

FOREIGN PATENT DOCUMENTS

| | | | |
|---|---|---|---|
| JP | H09-221837 | | 8/1997 |
| JP | H09-223837 | | 8/1997 |
| JP | 2009142866 A | * | 7/2009 |
| JP | 2017-140829 | | 8/2017 |
| JP | 2020-026066 | | 2/2020 |

OTHER PUBLICATIONS

Extended European Search Report for EP20209770.5 dated Apr. 6, 2021.

* cited by examiner

*Primary Examiner* — Matthew Luu
*Assistant Examiner* — Kendrick X Liu
(74) *Attorney, Agent, or Firm* — IPUSA, PLLC

(57) ABSTRACT

An image recording apparatus includes a light source, a switching drive circuit configured to control an electric current for causing the light source to emit a light beam, a moving part configured to move one of a recording target on which an image is to be recorded by the light beam and a light emitting position at which the light beam is emitted relative to another one of the recording target and the light emitting position, and a controller configured to control a light emission timing of the light source and a relative moving speed of the moving part based on image information. The drive circuit includes a switching circuit configured to turn on and off a switching element. The controller is configured to change a switching frequency of the switching element according to at least one of the light emission timing and the relative moving speed.

5 Claims, 22 Drawing Sheets

IMAGE RECORDING APPARATUS, OUTPUT CONTROL METHOD, AND STORAGE MEDIUM

CROSS-REFERENCE TO RELATED APPLICATION

The present application claims priority under 35 U.S.C. § 119 to Japanese Patent Application No. 2019-215414, filed on Nov. 28, 2019, the contents of which are incorporated herein by reference in their entirety.

BACKGROUND OF THE INVENTION

1. Field of the Invention

An aspect of this disclosure relates to an image recording apparatus, an output control method, and a storage medium.

2. Description of the Related Art

There is a known image recording apparatus that irradiates a recording target with light such as a laser beam and records an image on a surface of the recording target with thermal energy. In a proposed configuration for such an image recording apparatus, a switching circuit is used to improve the power efficiency of a laser driver.

With a related-art switching laser driver, current noise called ripple noise may be generated due to switching operations of transistors in the circuit, and the current noise may cause image noise in an image recorded on a recording target.

Japanese Unexamined Patent Application Publication No. H09-221837 describes a laser power supply than can minimize ripples.

Image noise can be reduced by reducing ripple noise. However, when the power of a laser beam or the speed at which an image is recorded on a recording target is changed, the image quality may be reduced.

SUMMARY OF THE INVENTION

According to an aspect of this disclosure, there is provided an image recording apparatus that includes a light source, a switching drive circuit configured to control an electric current for causing the light source to emit a light beam, a moving part configured to move one of a recording target on which an image is to be recorded by the light beam and a light emitting position at which the light beam is emitted relative to another one of the recording target and the light emitting position, and a controller configured to control a light emission timing of the light source and a relative moving speed of the moving part based on image information. The drive circuit includes a switching circuit configured to turn on and off a switching element. The controller is configured to change a switching frequency of the switching element according to at least one of the light emission timing and the relative moving speed.

DESCRIPTION OF THE EMBODIMENTS

An aspect of this disclosure makes it possible to suppress reduction in the quality of an image recorded on a recording target due to switching noise in an image recording apparatus including a switching driver circuit.

Embodiments of the present invention are described below with reference to the accompanying drawings. To facilitate the understanding of the descriptions, the same reference number is assigned to the same component throughout the drawings, and repeated descriptions of the same component may be omitted as far as possible.

<Configuration of Image Recording Apparatus>

In an example described below, an image recording apparatus records an image on a recording target that is a structure including a thermal recording part, specifically, a transportation container on which a thermal recording label is attached.

In the present embodiment, "recording" indicates printing information such as a logo, a product name, a serial number, or a model number by melting, singing, peeling, oxidizing, scraping, or changing the color of a surface of a recording target by irradiating the recording target with light such as a laser beam. "Recording" may also be referred to as "non-contact marking", "laser marking", or "laser printing".

Figure 1:
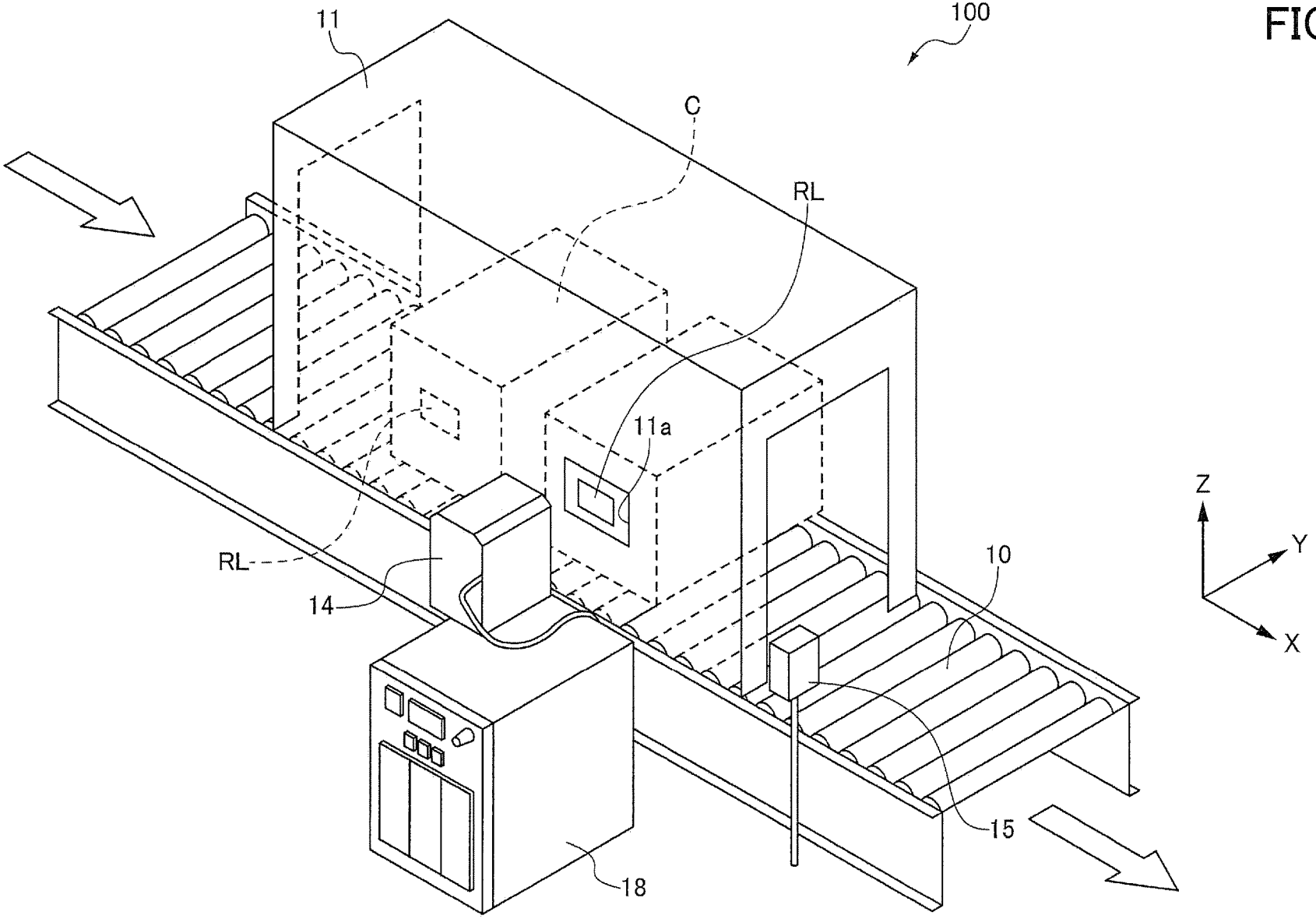
FIG. 1 is a perspective view of an image recording system that is an example of an image recording apparatus according to an embodiment.

FIG. 1 is a perspective view of an image recording system 100 that is an example of an image recording apparatus according to an embodiment. In the descriptions below, the conveying direction of a transportation container C is referred to as an X-axis direction, the vertical direction is referred to as a Z-axis direction, and the direction orthogonal to both of the conveying direction and the vertical direction is referred to as a Y-axis direction. As described in detail below, the image recording system 100 records an image by irradiating, with a laser beam, a thermal recording label RL attached to the transportation container C that is a recording target. As illustrated in FIG. 1, the image recording system 100 includes a conveyor apparatus 10 (moving part), which is a recording target conveying unit, a recording apparatus 14, a system control apparatus 18, a scanning apparatus 15, and a shielding cover 11.

The recording apparatus 14 irradiates the thermal recording label RL with a laser beam to record an image, which is a visible image, on the recording target. The recording apparatus 14 is disposed on the −Y side of the conveyor apparatus 10, i.e., on the −Y side of a conveying path.

The shielding cover 11 shields a laser beam emitted from the recording apparatus 14 to reduce the diffusion of the laser beam. A black alumite coating is provided on the surface of the shielding cover 11. An opening 11*a* for allowing passage of the laser beam is formed in a portion of the shielding cover 11 facing the recording apparatus 14. In the present embodiment, the conveyor apparatus 10 is a roller conveyor. However, the conveyor apparatus 10 may be a belt conveyor.

The system control apparatus 18 is connected to the conveyor apparatus 10, the recording apparatus 14, and the scanning apparatus 15 and controls the entire image recording system 100. As described later, the scanning apparatus 15 reads a code image such as a barcode or a QR code (registered trademark) recorded on a recording target. The system control apparatus 18 determines whether an image is correctly recorded based on information scanned by the scanning apparatus 15.

Figure 2:
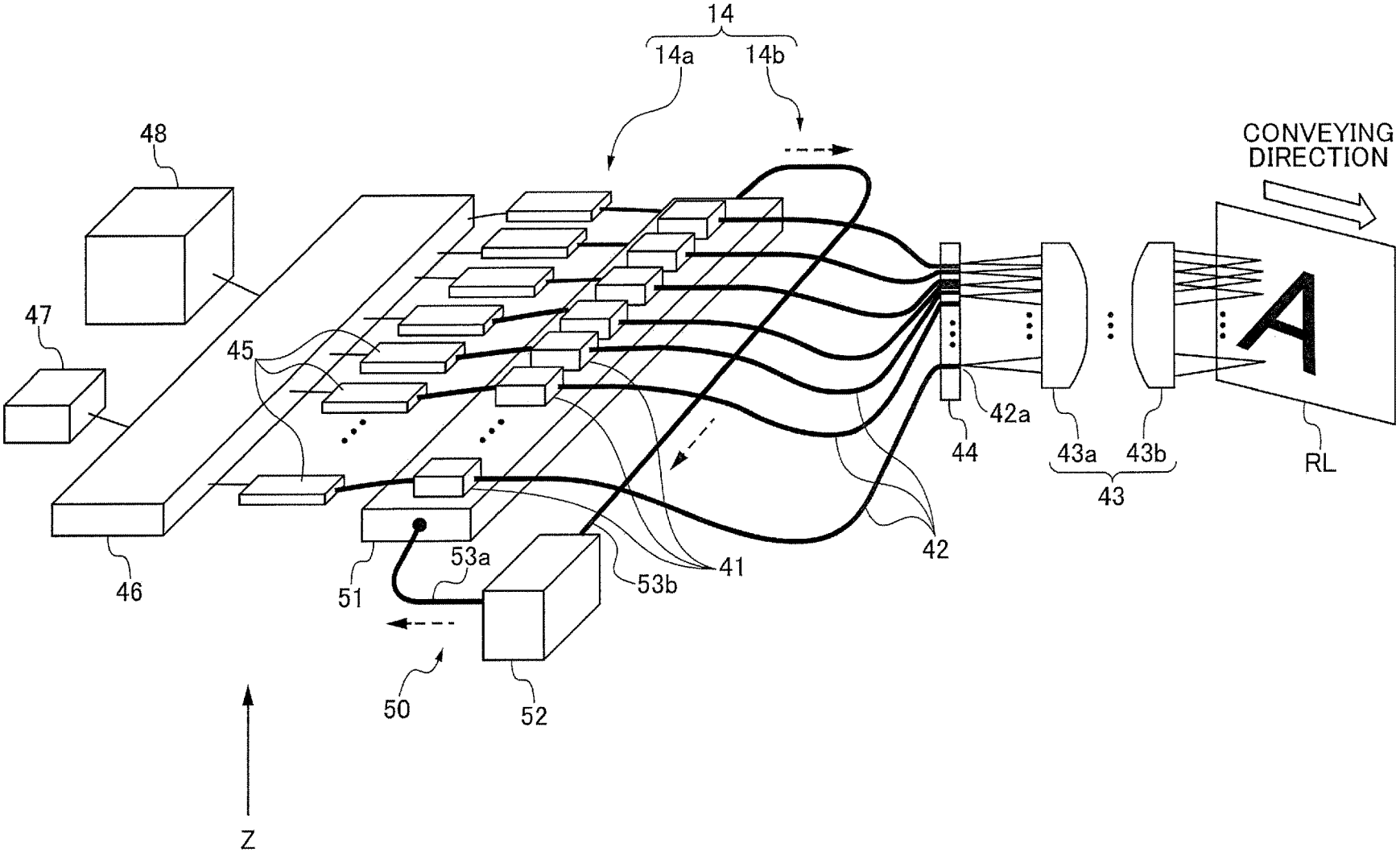
FIG. 2 is a perspective view illustrating an example of a configuration of a recording apparatus according to an embodiment.

FIG. 2 is a perspective view illustrating an example of a configuration of the recording apparatus 14 according to an embodiment. In the present embodiment, the recording apparatus 14 is implemented by a fiber array recording apparatus that records an image using a fiber array formed by arranging laser output parts of multiple optical fibers in a main-scanning direction (Z-axis direction) orthogonal to a sub-scanning direction (X-axis direction) that is the moving direction of the container C, i.e., a recording target. The fiber array recording apparatus irradiates a recording target with laser beams emitted from laser devices using the fiber array to record an image formed of drawing units. Specifically, the recording apparatus 14 includes a laser array 14*a*, a fiber array 14*b*, and an optical system 43. The laser array 14*a* includes multiple laser devices 41 (output elements or LDs) arranged in an array, a cooling unit 50 for cooling the laser devices 41, multiple drivers 45 that are provided for the respective laser devices 41 and drive the corresponding laser devices 41, and a controller 46 for controlling the drivers 45. The controller 46 is connected to a power supply 48 for supplying power to the laser devices 41 and an image information output unit 47 such as a personal computer that outputs image information.

The laser device (LD) 41 may be implemented by, for example, a semiconductor laser (laser diode), a solid-state laser, or a dye laser depending on the purpose. Among them, the laser device 41 is preferably implemented by a semiconductor laser because a semiconductor laser has wide wavelength selectivity and because a semiconductor laser has a small size and makes it possible to reduce the size and costs of the apparatus.

Although the wavelength of the laser beam emitted by the laser device 41 is not limited to any specific value and may be determined depending on the purpose, the wavelength of the laser beam emitted by the laser device 41 is preferably between 700 nm and 2000 nm and more preferably between 780 nm and 1600 nm.

In the laser device 41, which is a light emitting element, not all of the applied energy is converted into a laser beam. Normally, the energy not converted into a laser beam is converted into heat, and the laser device 41 generates heat. For this reason, the laser devices 41 are cooled by the cooling unit 50. Also, in the recording apparatus 14 of the present embodiment, because the fiber array 14*b* is used, the laser devices 41 can be distanced from each other. This configuration makes it possible to reduce the influence of heat from adjacent laser devices 41 and to efficiently cool the laser devices 41. This in turn makes it possible to prevent an increase and variation in the temperature of the laser devices 41, reduce variation in the power of laser beams, and reduce density unevenness and blanks.

The power of a laser beam is indicated by an average power measured by a power meter. There are two types of methods for controlling the power of a laser beam: a method where peak power is controlled and a method where a pulse emission ratio (duty: laser emission time/cycle time) is controlled.

The cooling unit 50 cools the laser devices 41 by circulating a coolant and includes a heat receiver 51 where the coolant receives heat from the laser devices 41 and a heat radiator 52 that radiates the heat of the coolant. The heat receiver 51 and the heat radiator 52 are connected to each other via cooling pipes 53*a* and 53*b*. The heat receiver 51 includes a case formed of a high thermal conductive material and a cooling tube disposed in the case and formed of a high thermal conductive material. The coolant flows through the cooling tube. The laser devices 41 are arranged in an array on the heat receiver 51.

The heat radiator 52 includes a radiator and a pump for circulating the coolant. The coolant fed by the pump of the heat radiator 52 passes through the cooling pipe 53*a* and flows into the heat receiver 51. While flowing through the cooling tube in the heat receiver 51, the coolant receives heat from the laser devices 41 arranged on the heat receiver 51 and thereby cools the laser devices 41. The coolant, whose temperature has increased as a result of receiving heat from the laser devices 41, flows out of the heat receiver 51, flows through the cooling pipe 53*b* into the radiator of the heat radiator 52, and is cooled by the radiator. The coolant cooled by the radiator is fed by the pump into the heat receiver 51 again.

The fiber array 14*b* includes multiple optical fibers 42 provided for the respective laser devices 41 and an array head 44 that holds portions of the optical fibers 42 near laser output parts 42*a* to form an array arranged in the vertical direction (Z-axis direction). Laser input parts of the optical fibers 42 are attached to the laser emitting surfaces of the corresponding laser devices 41.

The image information output unit 47 such as a personal computer inputs image data to the controller 46. The controller 46 generates drive signals for driving the drivers 45 based on the input image data. The controller 46 sends the generated drive signals to the drivers 45. Specifically, the controller 46 includes a clock generator. When the number of clocks generated by the clock generator reaches a predetermined number, the controller 46 sends drive signals for driving the drivers 45 to the drivers 45.

When receiving the drive signals, the drivers 45 drive the corresponding laser devices 41. The laser devices 41 emit laser beams when driven by the drivers 45. The laser beams emitted from the laser devices 41 enter the corresponding optical fibers 42 and are emitted from the laser output parts 42*a* of the optical fibers 42. The laser beams emitted from the laser output parts 42*a* of the optical fibers 42 pass through a collimator lens 43*a* and a condenser lens 43*b* of the optical system 43, and then enter the surface of the thermal recording label RL of the container C that is a recording target. The surface of the thermal recording label RL is heated by the laser beams and an image is recorded on the surface of the thermal recording label RL.

When a recording apparatus is configured to record an image on a recording target by deflecting a laser beam with a galvano mirror, an image such as a character is recorded unicursally by deflecting the laser beam with the rotation of the galvano mirror. Therefore, when a certain amount of information is to be recorded on a recording target, there is a problem that the recording cannot be completed in time unless the conveyance of the recording target is stopped. In contrast, with the recording apparatus 14 of the present embodiment that uses a laser array of multiple laser devices 41, an image can be recorded on a recording target by controlling the on and off of the laser devices 41 corresponding to pixels constituting the image. This configuration makes it possible to record an image on a recording target without stopping the conveyance of the container C even if the amount of information is large. Thus, the recording apparatus 14 of the present embodiment can record an image without reducing the productivity even when a large amount of information is recorded on a recording target.

Figure 3:
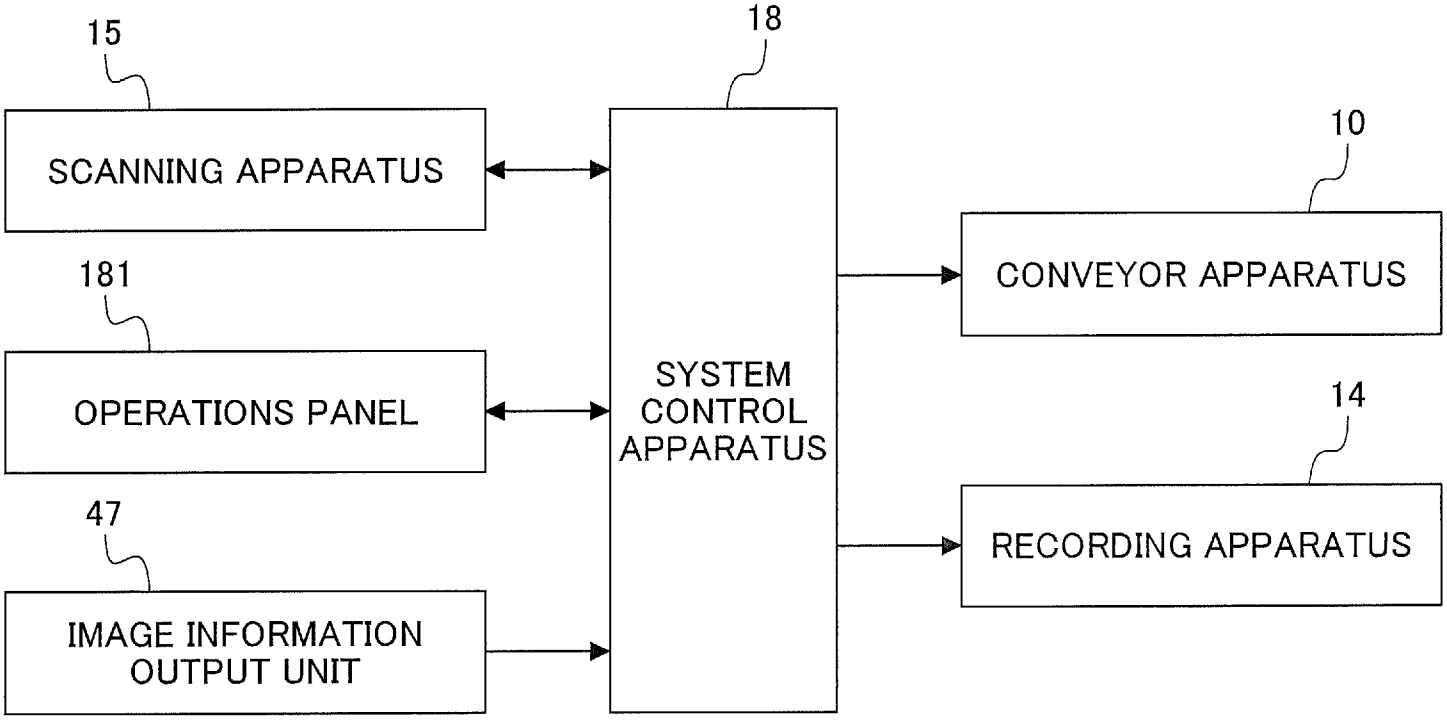
FIG. 3 is a block diagram illustrating a part of an electric circuit of an image recording system according to an embodiment.

FIG. 3 is a block diagram illustrating a part of an electric circuit of the image recording system 100 according to an embodiment. In FIG. 3, it is assumed that the system control apparatus 18 includes a CPU, a RAM, a ROM, and a non-volatile memory, controls various apparatuses in the image recording system 100, and performs various calculations. The conveyor apparatus 10, the recording apparatus 14, the scanning apparatus 15, an operations panel 181, and the image information output unit 47 are connected to the system control apparatus 18.

The operations panel 181 includes a touch panel display and various keys, displays images, and receives various types of information input by a worker by operating the keys.

As illustrated in FIG. 3, the CPU operates according to programs stored in, for example, the ROM, and the system control apparatus 18 thereby functions as an image recording unit. The system control apparatus 18 functioning as the image recording unit controls the recording apparatus 14 to irradiate, with laser beams, a recording target moving relative to the recording apparatus 14 in a direction different from a predetermined direction and thereby heat the recording target to form image dots and record an image.

Next, an example of the operation of the image recording system 100 is described with reference to FIG. 1. First, the container C containing baggage is placed on the conveyor apparatus 10 by the worker. The worker places the container C on the conveyor apparatus 10 such that the side surface of the body of the container C on which the thermal recording label RL is attached is located on the −Y side, i.e., such that the side surface faces the recording apparatus 14.

When the worker operates the operations panel 181 to start the system control apparatus 18, a conveyance start signal is sent from the operations panel 181 to the system control apparatus 18. Upon receiving the conveyance start signal, the system control apparatus 18 starts driving the conveyor apparatus 10. Then, the container C placed on the conveyor apparatus 10 is conveyed toward the recording apparatus 14 by the conveyor apparatus 10. An example of the conveying speed of the container C is 2 m/sec.

A sensor for detecting the container C being conveyed on the conveyor apparatus 10 is disposed upstream of the recording apparatus 14 in the conveying direction of the container C. When the sensor detects the container C, a detection signal is sent from the sensor to the system control apparatus 18. The system control apparatus 18 includes a timer. The system control apparatus 18 starts measuring time with the timer at the timing when the detection signal is received from the sensor. Then, the system control apparatus 18 determines the timing at which the container C reaches the recording apparatus 14 based on an elapsed time from the reception timing of the detection signal.

When the elapsed time from the reception timing of the detection signal becomes T1 and the container C reaches the recording apparatus 14, the system control apparatus 18 outputs a recording start signal to the recording apparatus 14 to record an image on the thermal recording label RL attached to the container C passing by the recording apparatus 14.

Upon receiving the recording start signal, the recording apparatus 14 emits laser beams with predetermined power toward the thermal recording label RL of the container C moving relative to the recording apparatus 14 based on image information received from the image information output unit 47. As a result, an image is recorded on the thermal recording label RL in a non-contact manner.

Examples of images (image information sent from the image information output unit 47) recorded on the thermal recording label RL include a text image indicating information such as the contents of baggage contained in the container C or a shipping destination and a code image such as a barcode or a two-dimensional code in which information such as the contents of baggage stored in the container C or a shipping destination is coded.

The container C, on which an image has been recorded while passing by the recording apparatus 14, passes by the scanning apparatus 15. The scanning apparatus 15 scans the code image such as a barcode or a two-dimensional code recorded on the thermal recording label RL, and obtains information such as the contents of baggage contained in the container C or a transportation destination. The system control apparatus 18 checks whether the image has been correctly recorded by comparing the information obtained from the code image with the image information sent from the image information output unit 47. When the image has been recorded correctly, the system control apparatus 18 sends the container C to the next stage (for example, a transportation preparation stage) by using the conveyor apparatus 10.

On the other hand, when the image has not been recorded correctly, the system control apparatus 18 temporarily stops the conveyor apparatus 10 and displays information indicating that the image has not been recorded correctly on the operations panel 181. Also, the system control apparatus 18 may be configured to convey the container C to a predetermined destination when the image has not been recorded correctly.

Figure 4:
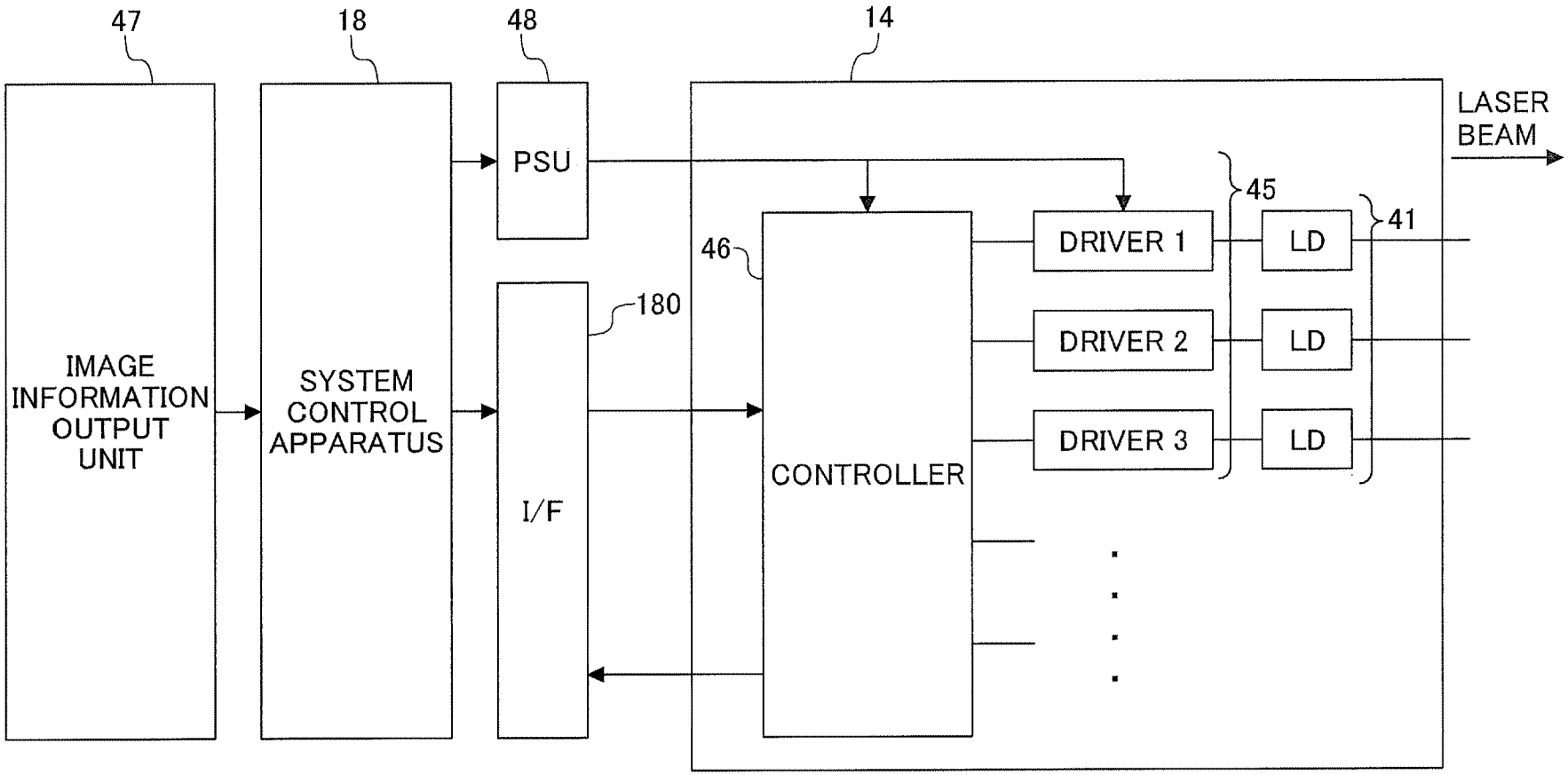
FIG. 4 is a block diagram of a recording apparatus in the electric circuit illustrated in FIG. 3.

FIG. 4 is a block diagram of the recording apparatus 14 in the electric circuit illustrated in FIG. 3. An I/F 180 is provided between the system control apparatus 18 and the controller 46.

The image information output unit 47 transmits information on optical energy necessary to output a desired dot density to the system control apparatus 18. The system control apparatus 18 transmits control signals indicating, for example, timing, a pulse width, and peak power as the information on the necessary optical energy via the I/F 180 to the controller 46, and receives a status signal via the I/F 180 from the controller 46.

A high-efficiency switching driver or a low-efficiency linear driver may be principally used as the driver 45 of the recording apparatus 14, any type of driver may be used in the present embodiment as long as the driver can output a pulse.

REFERENCE EXAMPLE

Figure 5:
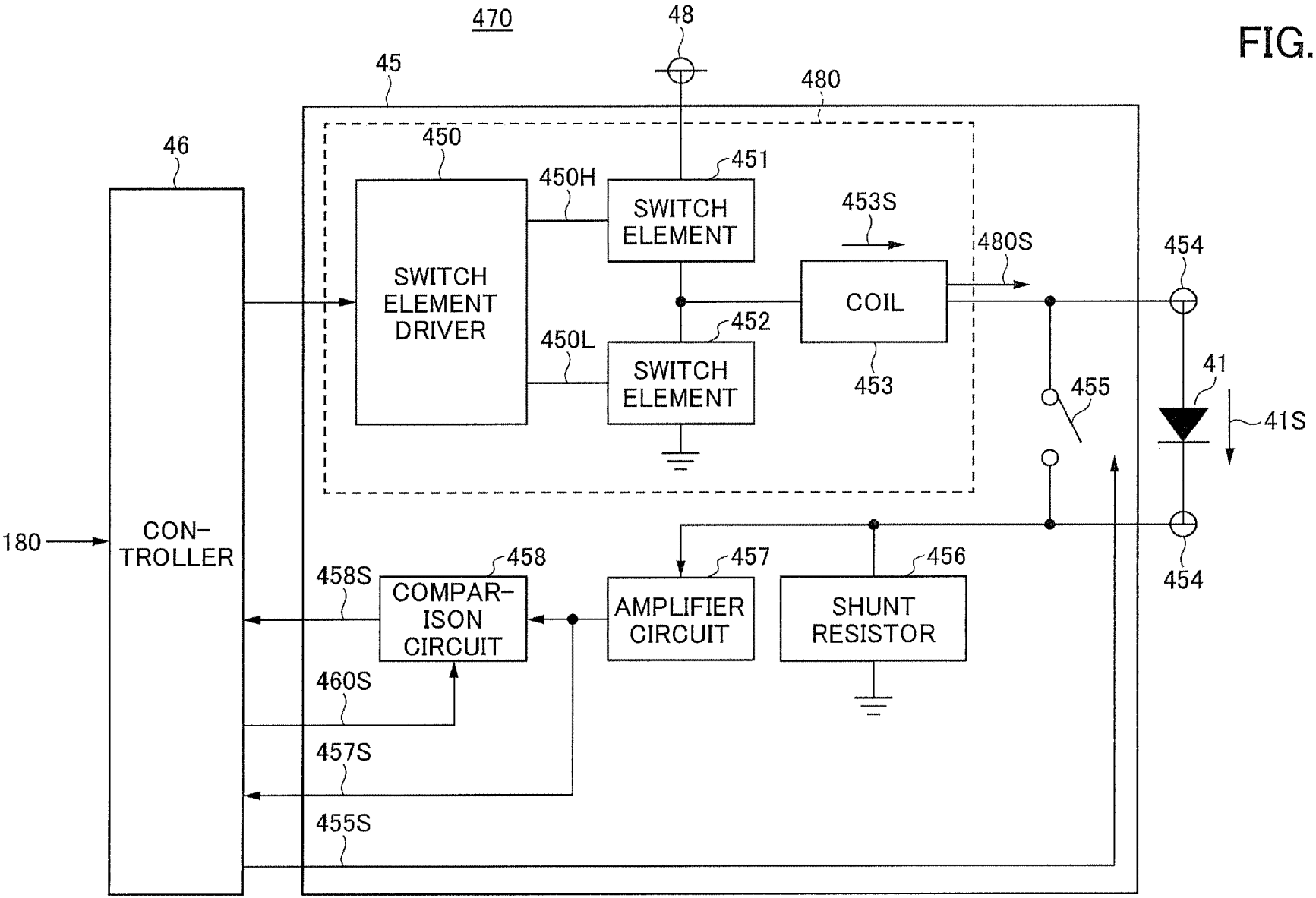
FIG. 5 is a drawing illustrating a configuration of a switching driver according to a reference example.

First, a basic circuit configuration of a switching driver is described with reference to FIGS. 5 through 9. FIG. 5 is a block diagram of the switching driver 45 illustrated in FIG. 4.

The driver 45 is a switching current drive circuit that supplies an electric current to a driving target connected to an output part 454 based on electric power supplied from the power supply 48.

The driver 45 includes, as a switching circuit 480 of the switching current drive circuit, a switch element driver 450, a switch element 451, a switch element 452, and a coil 453.

The switch element 451 switches the connection between the power supply 48 and the coil 453. The switch element 452 switches the connection between the GND and the coil 453.

A first end of the switch element 451 is connected to the power supply 48, a second end of the switch element 451 is connected to a first end of the switch element 452, and a second end of the switch element 452 is connected to the GND. An input end of the coil 453 is connected to the second end of the switch element 451 and the first end of the switch element 452, and an output end of the coil 453 is connected to a first end of the output part 454.

The laser device 41, which is the driving target of the driver 45, is connected to the output part 454. Alternatively, an LED may be connected to the output part 454 as a driving target of the driver 45.

The driver 45 also includes a light emission controller 455 as a current supply controller that turns on and off the supply of an electric current to the driving target connected to the output part 454, a shunt resistor 456 that converts (IV conversion) an electric current flowing to the driving target connected to the output part 454 or an electric current flowing to the light emission controller 455 into a voltage, an amplifier circuit 457 that amplifies the voltage applied to the shunt resistor 456, and a comparison circuit 458 that compares an amplified voltage 457S output from the amplifier circuit 457 with a threshold voltage 460S.

Switching operations of the driver 45 are described below. The switch element driver 450 outputs a drive signal 450H that turns on and off the switch element 451 and a drive signal 450L that turns on and off the switch element 452 according to control signals from the controller 46.

This configuration makes it possible to chop electric power supplied from the power supply 48 by turning on and off the switch elements 451 and 452, which are semiconductor switch elements such as MOSFETs, and by using the coil 453 as a smoothing device that smooths an electric current, and thereby obtain an output current 480S of the switching circuit 480 that is rectified into a substantially direct current.

The output current 480S flows from the light emission controller 455 via the shunt resistor 456 to the ground when the light emission controller 455 is on, and flows from the laser device 41 via the shunt resistor 456 to the ground when the light emission controller 455 is off.

The amplifier circuit 457 amplifies the voltage (the potential at the connection point among the laser device 41, the light emission controller 455, and the shunt resistor 456) applied to the shunt resistor 456 with a predetermined gain, and outputs an amplified voltage 457S.

The comparison circuit 458 compares the amplified voltage 457S output from the amplifier circuit 457 with the threshold voltage 460S output from the controller 46, and outputs a determination signal 458S indicating the comparison result to the controller 46.

Based on the determination signal 458S, the controller 46 outputs a control signal to the switch element driver 450 as described above. How the controller 46 outputs the control signal to the switch element driver 450 based on the determination signal 458S is described later with reference to FIG. 7. The comparison circuit 458 includes, for example, a comparator and an AD converter.

The driver 45 and the controller 46 described above constitute an output control apparatus 470 that controls the output current 480S, which is an electric current supplied to the output part 454. Further, a laser output apparatus is formed by connecting the laser device 41 as a driving target to the output part 454 of the output control apparatus 470.

In FIG. 5, to perform pulse modulation at high speed, the light emission controller 455, which controls the laser device 41 to emit or not emit a light beam by switching the path of the electric current flowing to the laser device 41 as a light emitting element, is connected parallel to the output part 454. The light emission controller 455 is implemented by, for example, a switching element such as a MOSFET.

In general, the modulation speed of an electric current flowing through a coil is proportional to the voltage applicable to ends of the coil, and current transition of 1A takes several microseconds. On the other hand, the modulation speed of a drive current by the light emission controller 455 depends on the switching time (several tens of ns for MOSFET) of the switching element of the light emission controller 455 and is therefore very high.

The controller 46 sends a PWM control signal 455S to the light emission controller 455 as a switching signal (light emission information) for turning the light emission controller 455 on and off. When the pulse frequency is 40 kHz (1 period=25 μs) and the recording apparatus 14 has 256 gray levels, one pixel corresponds to a pulse width of about 0.1 μs (100 ns). For example, when a pulse with a duty of 50% (128 gray levels) is to be output, the pulse width is about 12.8 μs.

In FIG. 5, the controller 46 monitors (detects) the amplified voltage 457S output from the amplifier circuit 457. When controlling the light emission of the laser device 41 by PWM control, the controller 46 sends the PWM control signal 455S, which is determined based on the amplified voltage 457S, to the light emission controller 455. How the controller 46 determines the PWM control signal 455S to be sent to the light emission controller 455 based on the amplified voltage 457S is described later with reference to FIG. 7.

Figure 6:
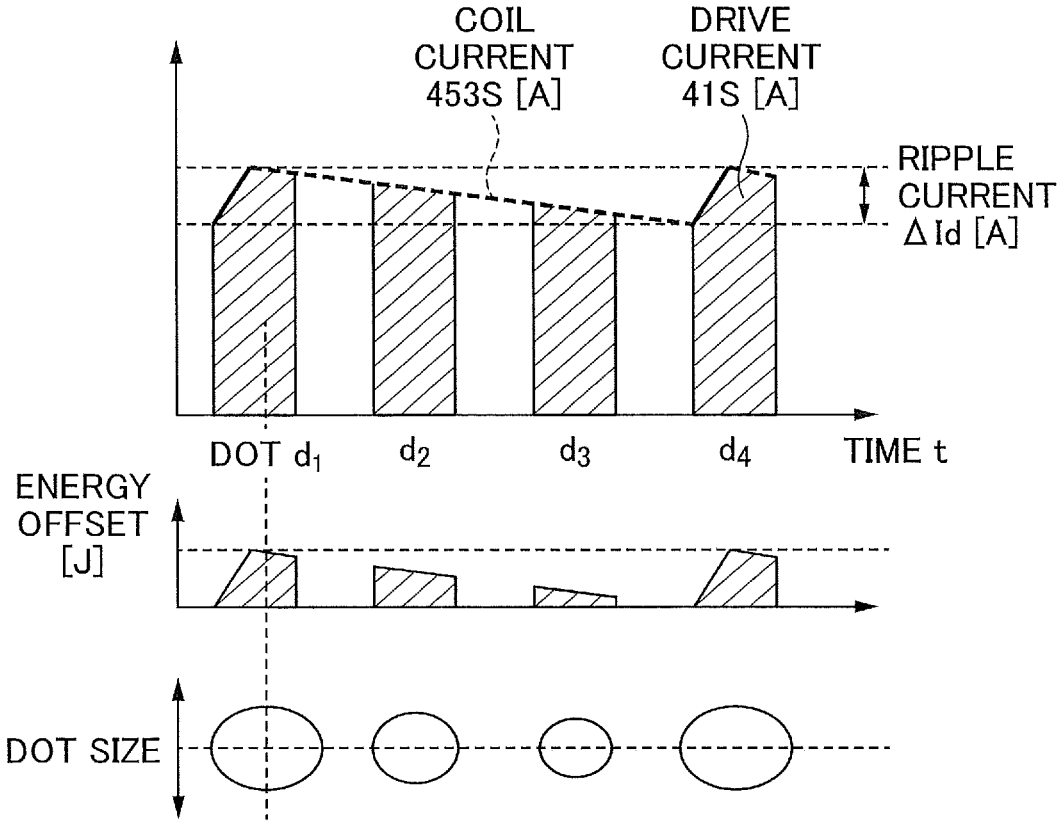
FIG. 6 is a drawing illustrating dot size variation caused by a ripple current.

FIG. 6 illustrates a typical waveform of noise on an optical output as an example of an operation waveform of the circuit illustrated in FIG. 5. FIG. 6 illustrates dot size variation caused by a ripple current.

The ripple of an electric current 453S flowing through the coil varies as a result of the operation of the switching circuit 480, and the controller 46 controls the electric current to maintain a target value. The pulse timings of an output current 41S to the LD41 for forming dots (d1, d2, d3, and d4) are determined by the light emission controller (switch) 455. Depending on the height of the coil current 453S at each pulse timing, the integral value of the output current 41S and the energy value of the laser beam pulse corresponding to a pixel vary from one pulse to another.

When the optical energy per pixel varies, the dot size formed on a medium varies, and the quality of a formed image is reduced. In the example of FIG. 6, the variation of the drive current 41S for each dot is represented by a ripple current Id [A], and the variation of energy corresponding to the ripple current Id is illustrated as an energy offset. The dot size varies depending on the amount of the energy offset.

In Japanese Unexamined Patent Application Publication No. H09-221837, the dot size variation is corrected by suppressing ripple noise. On the other hand, an embodiment of the present invention provides a noise spreading method where dot size variation is allowed but the spatial distribution of the dot size variation is spread according to certain conditions so that the dot size variation is less likely to be recognized as unevenness due to human visual characteristics.

Figure 7:
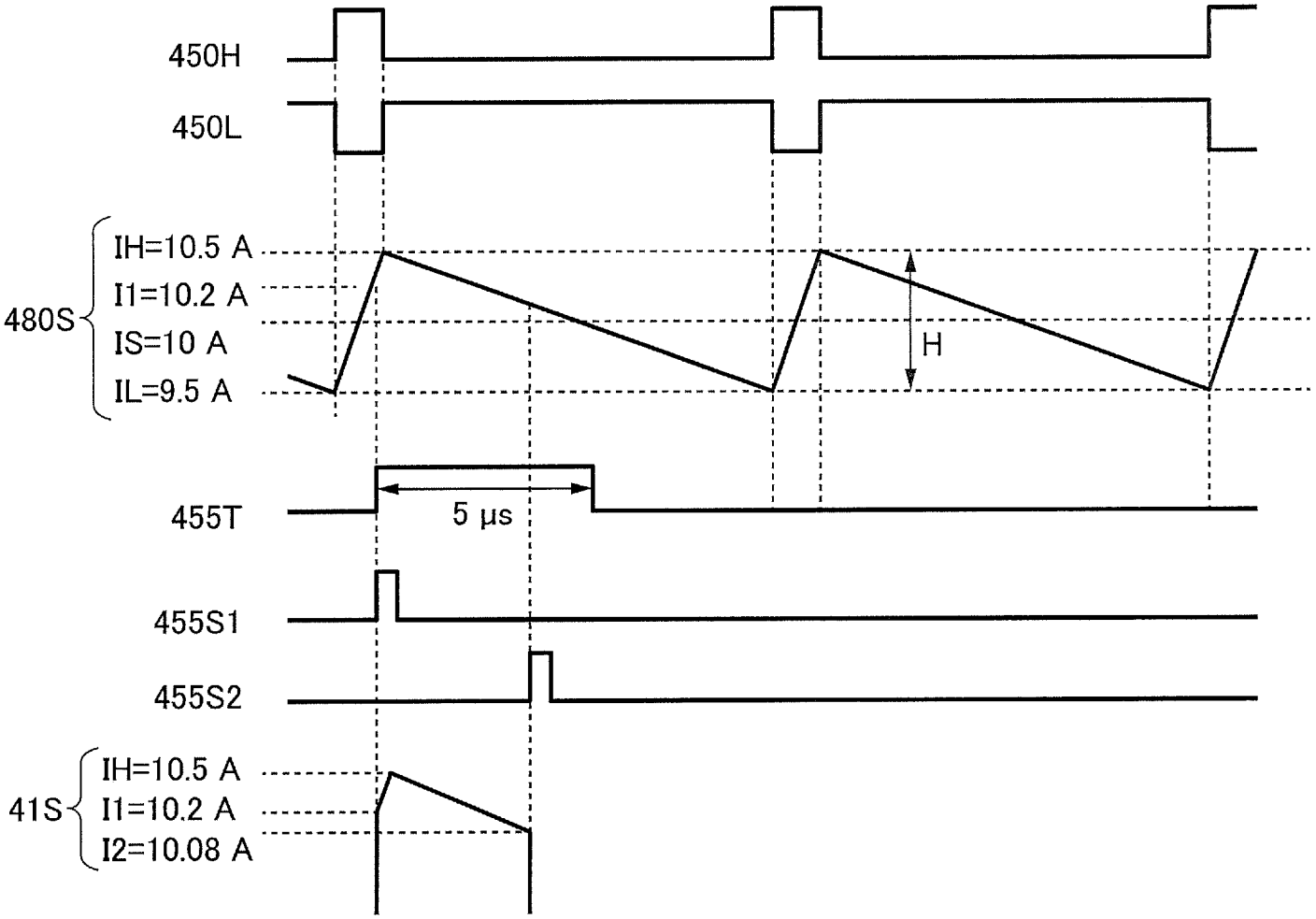
FIG. 7 is a timing chart illustrating operations of a driver where a drive current illustrated in FIG. 6 is generated.

Here, the mechanism how a ripple current as illustrated in FIG. 6 is generated in the switching driver 45 is described with reference to FIG. 7. FIG. 7 is a timing chart illustrating operations of a driver where a drive current illustrated in FIG. 6 is generated.

The relationship between the timings of the drive signal 450H and the drive signal 450L and the ripple component of the output current 480S (the coil current 453S in FIG. 6) supplied by the driver 45 to the output part 454 is described below.

The voltage at the output end of the coil 453 is $V=L\times\Delta I/dt$ (L: inductance of the coil 453, dt: variation of time, ΔI: variation of the coil current 453S). The duration for which the drive signal 450H is on and the drive signal 450L is off after the drive signal 450H is turned on (off→on) and the drive signal 450L is turned off (on→off) corresponds to the duration during which the ripple rises. In the duration during which the ripple rises, an electric current is supplied from the power supply 48 to the coil 453, and a voltage Vout at the output end of the coil 453 transitions to a voltage Vin of the power supply 48. Accordingly, the slope of the rising ripple is $\Delta I1/dt1=(Vin-Vout)/L$ (dt1: the duration for which the drive signal 450H is on and the drive signal 450L is off, ΔI1: variation of the coil current 453S during dt1).

Also, the duration for which the drive signal 450H is off and the drive signal 450L is on after the drive signal 450H is turned off (on→off) and the drive signal 450L is turned on (off→on) corresponds to the duration during which the ripple falls. In the duration during which the ripple falls, the electric current is not supplied from the power supply 48 to the coil 453, and the voltage Vout at the output end of the coil 453 transitions to 0. Accordingly, the slope of the falling ripple is $\Delta I2/dt2=(-Vout)/L$ (dt2: the duration for which the drive signal 450H is off and the drive signal 450L is on, ΔI2: variation of the coil current 453S during dt2).

The operation of the driver 45 is described in more detail below. Parameters assumed in FIG. 7 are described below.

Input voltage of the power supply 48: Vin=24 V

Voltage applied to the ends of the laser device 41: VLD=2 V

Inductance of the coil 453: L=22 μH

Target current of the current 41S flowing through the laser device 41: IS=10 A Target consumption energy in the light emitting period of the laser device 41: 100 μJ Theoretical pulse width as the light emitting period of the laser device 41: 100 μJ/(2 V×10 A)=5 μs.

The ripple current cannot be completely eliminated (0) due to the configuration of the switching current drive circuit. Here, it is assumed that the ripple current in a steady state where the switching current drive circuit (the driver 45) operates stably is 1A. A threshold current IH corresponding to an upper limit 460H of the threshold voltage is 10 A+1/2 A=10.5 A as the higher threshold current for hysteresis control because the ripple current is the peak-to-peak value. A threshold current IL corresponding to a lower limit 460L of the threshold voltage 460S is 10 A−1/2 A=9.5 A.

A rising slope S1 of the ripple current is $\Delta I/dt=(Vin-VLD)/L=(24-2)/22=1$ A/μs. A falling slope S2 of the ripple current is $\Delta I/dt=(Vin-VLD)/L=(-2)/22=-0.09$ A/μs.

To output a dot pulse with a target current of 10 A, an output voltage (load voltage) of 2 V, and a target energy of 100 μJ, assuming that the light intensity can be kept constant over time, the light intensity per unit time is 10 A×2 V=20 W, and 100 μJ/20 W=5 μs is the ideal irradiation time (theoretical pulse width 455T). This corresponds to a pulse width with a duty of 20% at 40 kHz. To keep the error of the pulse width of 5 μs within±0.5%, a time resolution of 5 μs×1%=0.05 μs is necessary. That is, the time resolution of the PWM control signal for turning on and off the light emission controller 455 is 0.05 μs.

In this reference example, the current 41S flowing through the laser device 41 always has a ripple. Therefore, even when the laser device 41 is caused to emit light for the theoretical pulse width 455T (5 μs), the target energy 100 μJ may not always be obtained.

Therefore, in the reference example, the energy summation is started at the timing when the light emission controller 455 is turned off by the PWM control signal 455S (the timing when the output current 480S is supplied to the laser device 41 and the current 41S flows), and the energy is summed every time resolution. Then, at the timing when the sum of the energy exceeds the target energy 100 μJ, the energy summation is ended and the light emission controller 455 is turned on by the PWM control signal 455S to stop the supply of the output current 480S to the laser device 41 and thereby stop the flow of the electric current 41S.

In FIG. 7, the controller 46 obtains the value of the output current 480S from the amplified voltage 457S according to the following formula: I=(V/G)/R (I: value of the output current 480S, V: value of the amplified voltage 457S, G: amplification degree of the amplifier circuit 457, R: resistance value of the shunt resistor 456). In the reference example, the output current 480S is obtained from the amplified voltage 457S obtained by amplifying the voltage applied to the shunt resistor 456 by the amplifier circuit 457. Alternatively, the output current 480S may be obtained by using a Hall current sensor.

Here, as described above, the output current 480S flowing through the laser device 41 is referred to as the current 41S. In the descriptions below, the electric current flowing while the laser device 41 emits light is referred to as the current 41S instead of the output current 480S.

When the output current 480S drops and reaches the threshold current IL, the controller 46 turns on the drive signal 450H and turns off the drive signal 450L. As a result, the output current 480S starts to increase.

Then, while the output current 480S is rising, the controller 46 sends a PWM control signal 455S1 based on the drive signal sent from the image information output unit 47 to turn off the light emission controller 455 and thereby turn on the laser device 41, obtains an electric current of 10.2 A at this timing as an initial current value I1, and starts energy summation.

Then, when the current 41S (the output current 480S) flowing through the laser device 41 reaches the threshold current IH (10.5 A), the controller 46 turns off the drive signal 450H and turns on the drive signal 450L. As a result, the current 41S starts to decrease. During this process, the controller 46 continues the energy summation.

Then, while the current 41S is decreasing, when the sum of the energy reaches the target energy 100 μJ at the timing when a current value I2 (10.08 A) is obtained, the controller 46 ends the energy summation, and sends a PWM control signal 455S2 to turn on the light emission controller 455 and thereby stop the laser device 41 to emit light.

Next, with reference to FIGS. 8A through 8D, a printed image output in the reference example and a printed image output in an embodiment described later are compared and explained. FIGS. 8A through 8D illustrate differences between printed images before and after the embodiment is applied.

Figure 8A:
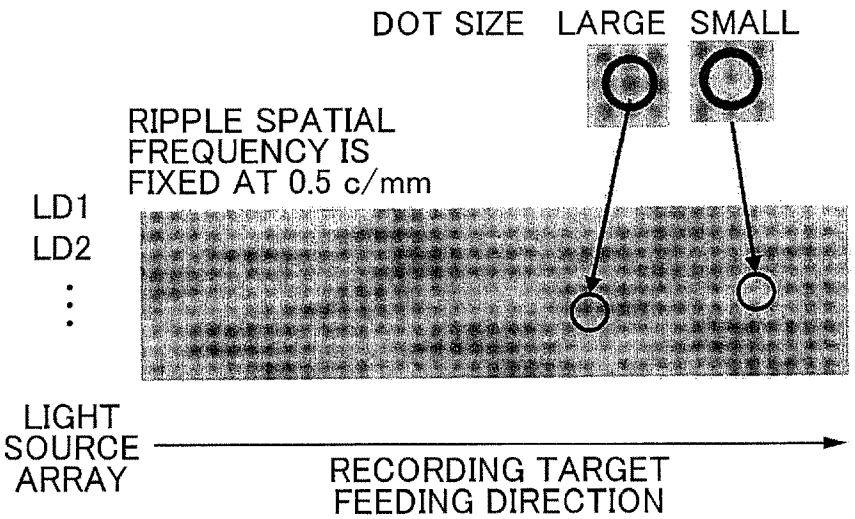
FIGS. 8A through 8D illustrate differences between printed images before and after the embodiment is applied.
Figure 8B:
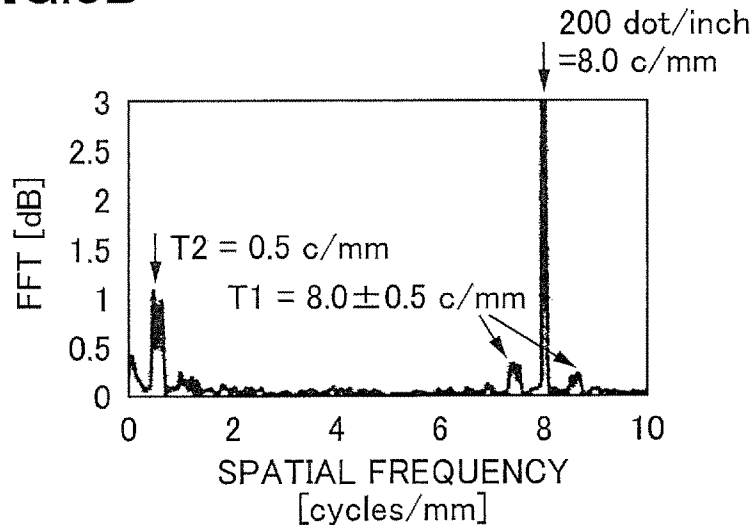
Figure 8C:
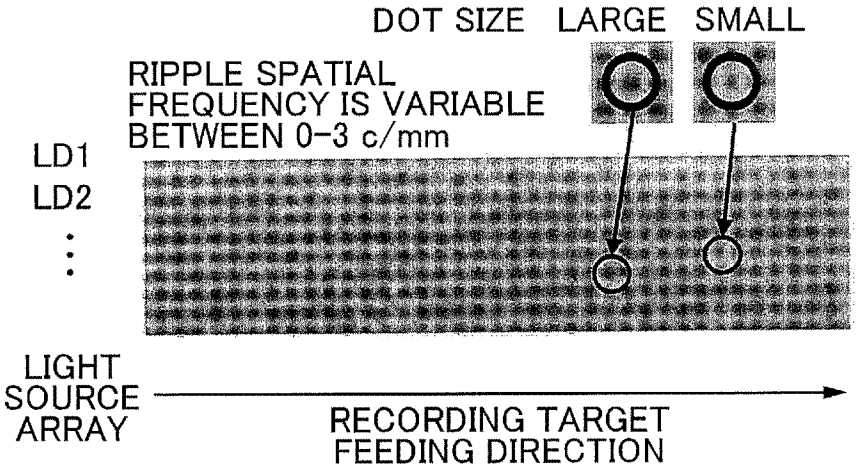

FIG. 8A illustrates a printed image before the embodiment is applied (reference example), and FIG. 8B is a graph indicating a Fourier transformation result (frequency characteristics) of the printed image of the reference example. FIG. 8C is a printed image after the embodiment is applied, and FIG. 8D is a graph indicating the frequency characteristics of the printed image of the embodiment.

In the printed images before and after the application of the embodiment illustrated in FIGS. 8A and 8C, the variable amplitudes of dot sizes are substantially the same, but the spatial distributions of dot sizes are different from each other. The distribution of dot sizes in FIG. 8A varies at a constant cycle of 0.5 [cycles/mm]. On the other hand, the distribution of dot sizes in FIG. 8C is spread at a cycle of 0 to 3 [cycles/mm].

Figure 8D:
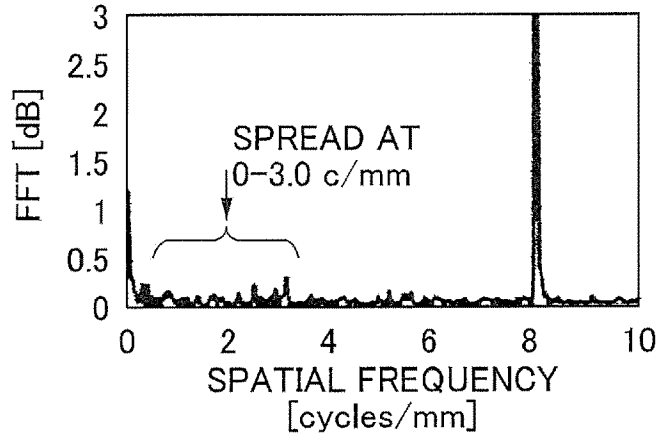

FIGS. 8B and 8D are graphs obtained by applying one-dimensional Fourier transformation (1D-FFT) to dot density variations in the conveying direction of the recording targets illustrated in FIGS. 8A and 8C. The horizontal axis in each of FIGS. 8B and 8D indicates a spatial frequency [cycles/mm]. Here, the spatial frequency indicates the number of cycles of a waveform per 1 mm. In the descriptions below, the unit of spatial frequency may be abbreviated to [c/mm].

As illustrated in FIG. 8B, in the image before the application of the embodiment, periodic unevenness is observed at a dot cycle of 8.0 [cycles/mm] and at 0.5 [cycles/mm] as superimposed noise. Also, there are peaks at 8.0±0.5 [cycles/mm] corresponding to a sum frequency and a difference frequency that are generated when two frequencies (a pixel frequency fdot and a ripple frequency fsw) overlap each other due to the light emission timing of the laser device 41 as illustrated in FIG. 6. Hereafter, the sum frequency and the difference frequency may be indicated by a reference sign T1. The mechanism how the sum frequency and the difference frequency are generated is described later with reference to FIG. 12 and FIG. 13. The pixel frequency fdot is a frequency at which, for example, the dots d1, d2, d3, and d4 illustrated in FIG. 6 are recorded. The ripple frequency is the same as the switching frequency fsw and is the frequency of noise (switching noise) generated by the switching operation of the switching circuit 480. The peak at 8.0 [cycles/mm] in FIG. 8B, which is called a dot cycle, is the peak of the spatial frequency caused by the pixel frequency fdot, and is calculated by dividing the pixel frequency fdot [Hz] by the conveying speed v [mm/s]. The "conveying speed" used in the present embodiment indicates the speed at which the conveyor apparatus 10 conveys the container C (recording target) in one direction. The peak at 0.5 [cycles/mm] in FIG. 8B, which is called superimposed noise, is the peak of the spatial frequency caused by the switching frequency fsw, and is also referred to as a ripple cycle T2. The ripple cycle T2 can be calculated by dividing the switching frequency fsw [Hz] by the conveying speed v [mm/s].

As illustrated in FIG. 8D, in the image after the application of the embodiment, peaks other than the pixel frequency fdot are spread (i.e., the peak of the ripple cycle T2 generated at 0.5 [cycles/mm] and the peaks of the sum and difference frequencies T1 generated at 8.0±0.5 [cycles/mm] in FIG. 8B are spread and averaged). As a result, in the printed image in FIG. 8C, density unevenness is less perceivable and the image quality is improved.

Figure 9:
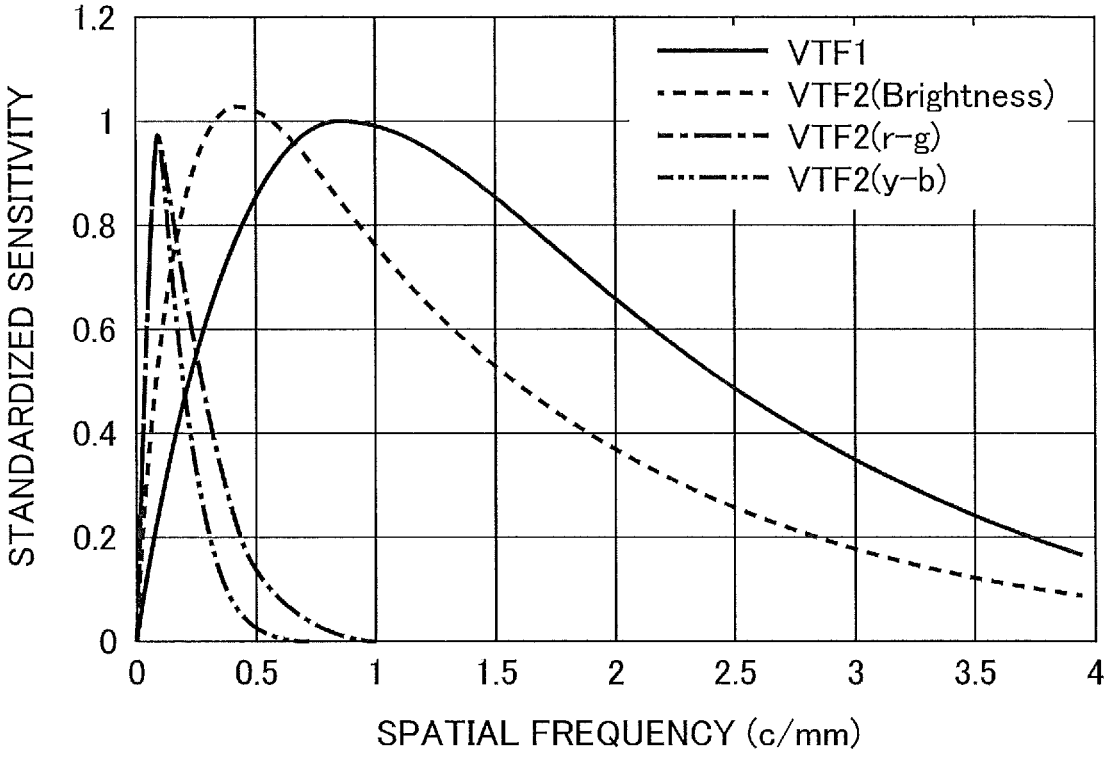
FIG. 9 is a graph illustrating spatial frequency characteristics of human vision.

FIG. 9 illustrates the spatial frequency characteristic of human vision (VTF: Visual Transfer Function) that explains why the effects of the embodiment are achieved. FIG. 9 is a graph weighted by the variation amplitude of the brightness component of a monochrome image and the spatial frequency characteristic of human vision, and is already known as an index used for evaluating the granularity of a monochrome image (see, for example, "Ricoh Technical Report, Noise Evaluation Method for Halftone Color Image, Susumu Imakawa, https://jp.ricoh.com/-/Media/Ricoh/Sites/jp_ricoh/technology/techreport/23/pdf/056_062.pdf"). VTF1 is the VTF of brightness variation proposed by Dooley et al. in "R. P. Dooley, R. Shaw: Noise Perception in Electrophotography, J.Appl.Photogr.Eng., 5, 4 (1979), pp.190-196". VTF2 indicates VTF curves of the variations of a brightness component, a red-green component, and a yellow-blue component reported by Sakata et al. in "H. Sakata, H. Isono: Chromatic Spatial Frequency Characteristics of Human Visual System, J.ITE of Japan, 31, 1 (1979), pp.29-35".

Although human psychological evaluation values vary depending on reports, as illustrated in FIG. 9, a large number of evaluation values (50% or more of the normalized brightness amplitude) are weighted in the range of brightness variation cycles between 0 and 3 [c/mm]. It is possible to improve the image quality by controlling such that no peak is generated in the range of brightness variation cycles between 0 and 3 [c/mm] by using the knowledge of human's subjective weighting on image quality.

As a guideline for the amount of spreading, it is preferable to spread as far as uniformly, non-periodically, and widely in the range between 0 and 3 [cycles/mm]. Spread Spectrum Clock Generator (SSCG) is known as a frequency spreading technology. The spreading range of SSCG is based on the degree of occurrence of radio interference, and the upper limit of the amount of spreading is generally about ±3% with respect to the basic frequency. Although the effect can be increased by spreading the switching cycle with, for example, a random number generator, when the cost and the effect are considered, a frequency modulation technology such as SSCG may be used in combination.

Two embodiments of the present invention are described below. As explained with reference to FIGS. 8A through 8D, periodic image unevenness occurs due to two causes.

(pixel frequency *fdot*±noise frequency *fsw*)[*Hz*]/conveying speed *v*[mm/s] (sum and difference frequencies *T*1) (1)

noise frequency *fsw*[*Hz*]/conveying speed *v* [mm/s] (ripple cycle *T*2) (2)

The ripple cycle T2 expressed by formula (2) above is spatial density unevenness that appears when the recording target being conveyed at a certain conveying speed v is irradiated (scanned) with a laser beam with periodic noise. In the embodiment, when noise frequency=switching frequency fsw and the circuit is configured such that the switching frequency fsw can be modulated arbitrarily, it is technically easy to spread in a spatial frequency between 0 and 3 cycles/mm.

The sum and difference frequencies T1 represented by formula (1) above are caused by sum and difference frequency components generated when the pixel frequency fdot and the noise frequency (switching frequency fsw) overlap each other. As described later with reference to FIG. 12 and FIG. 13, this is based on the phenomenon where a frequency different from the frequencies of original signals is generated when different frequency signals are mixed.

For the above phenomena (1) and (2), circuit configurations where the phenomena are likely to occur and countermeasure control methods for the phenomena are described below as a first embodiment and a second embodiment.

First Embodiment

Figure 10:
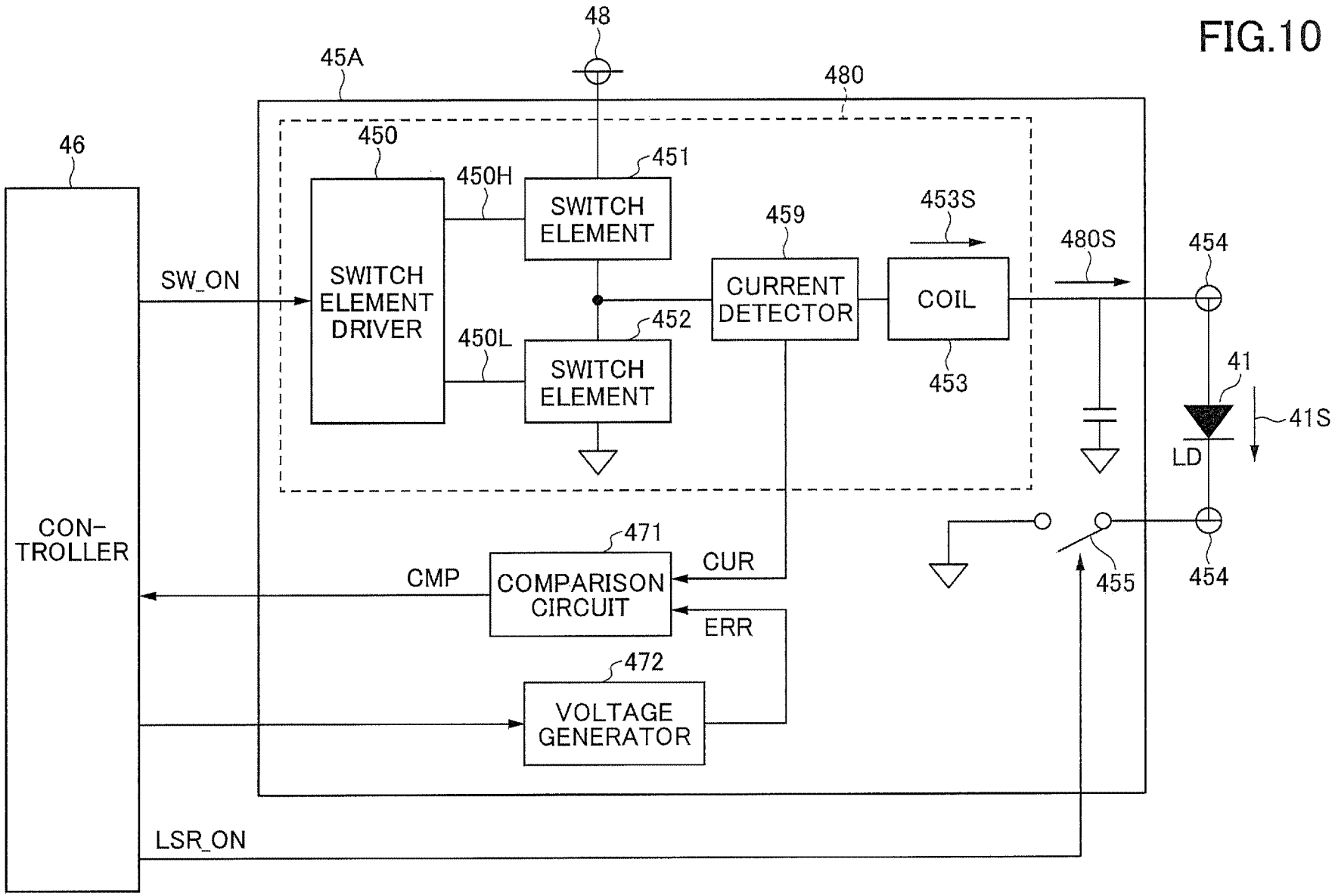
FIG. 10 is a drawing illustrating an example of a configuration of a switching driver according to a first embodiment.
Figure 11:
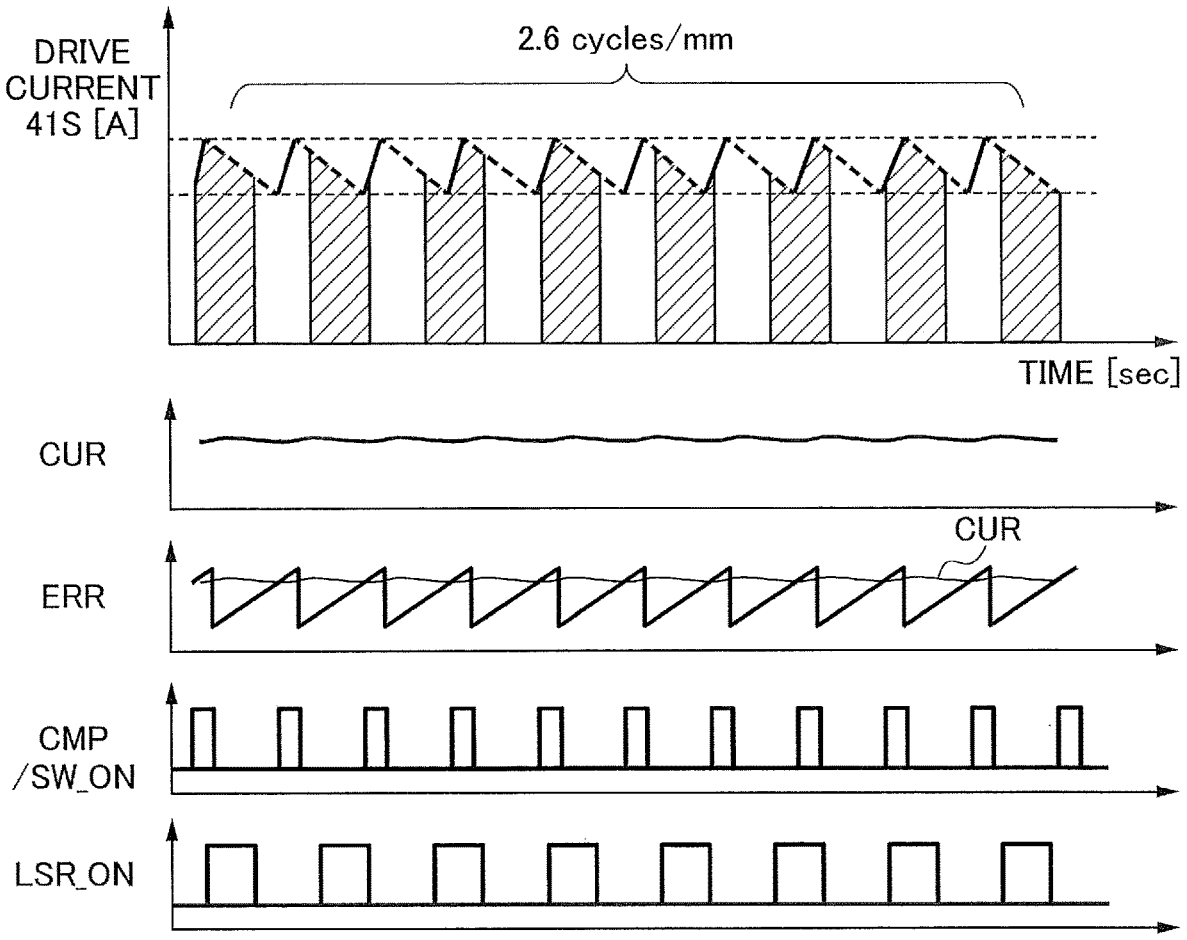
FIG. 11 is a timing chart of driver operations before spatial frequency control is applied.

A first embodiment is described with reference to FIGS. 10 through 17. FIG. 10 is a drawing illustrating a switching driver 45A according to the first embodiment. FIG. 11 is a timing chart of driver operations before spatial frequency control is applied.

As illustrated in FIG. 10, in the driver 45A, a power supply voltage 41S is chopped by the switch elements 451 and 452, and the current is smoothed by an output filter including the coil 453. In response to an LSR_ON signal, a pulse current is applied to the LD 41 by grounding the LD anode with the light emission controller 455. The LD current is monitored and fed back with a current detector 459 to control the flowing current 41S to be constant. The current detector 459 is a current detection sensor such as a Hall element or a shunt resistor, converts the flowing current value into a voltage value, and outputs the voltage value as a CUR signal to a comparison circuit 471.

As illustrated in FIG. 11, the driver 45A of the first embodiment employs a PWM control method using a sawtooth ERR signal. The circuit topology and the control method may be freely selected according to general switching circuit design conditions.

The driver 45A includes the comparison circuit 471 and a voltage generator 472. The voltage generator 472 generates an ERR signal in response to a command from controller 46. The comparison circuit 471 compares the CUR signal corresponding to the output current 480S measured by the current detector 459 with the ERR signal generated by the voltage generator 472, and outputs a determination signal CMP indicating the comparison result to the controller 46. As illustrated in FIG. 11, for example, the determination signal CMP is turned on while the sawtooth ERR signal is greater than the CUR signal. The controller 46 outputs a SW_ON signal, which has the same waveform as the determination signal CMP, to the switching circuit 480, and the switching circuit 480 controls the output current 480S according to the SW_ON signal.

The advantage of the driver 45A of the first embodiment is that because the switching frequency can be freely selected by the modulation of the ERR signal, the noise spatial frequency described with reference to FIGS. 8A through 8D can be easily set. On the other hand, the disadvantages of the driver 45A are that because the driver 45A is based on PWM control, the responsiveness to load variation is poor and the filter tends to become large. If a small multiplier is selected to reduce the size, the amplitude of the ripple current may increase, which results in an increase in the amount of output noise, or the switching frequency may increase, which results in a decrease in efficiency. Examples of noise generated in the circuit are described below.

Figure 12:
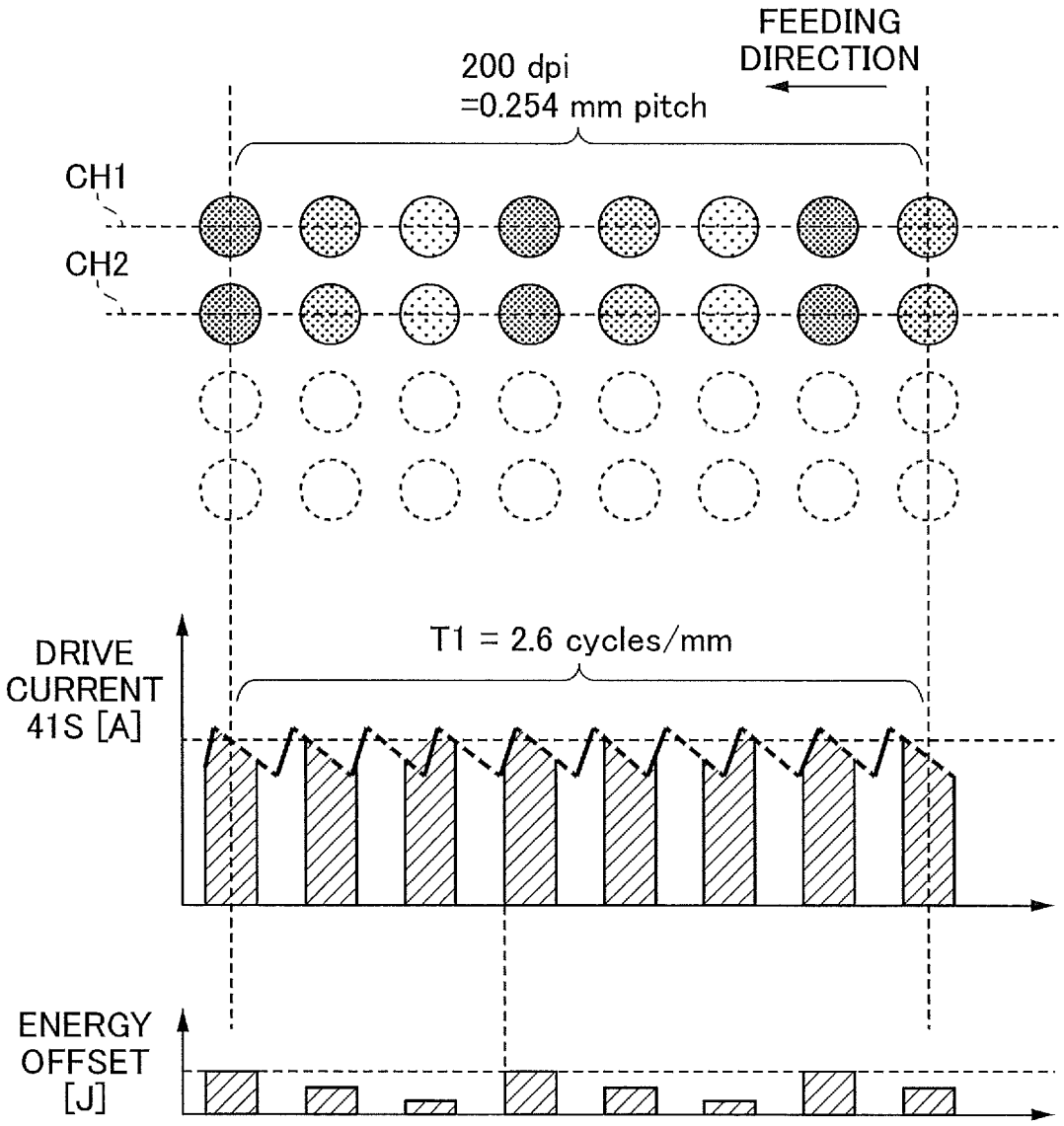
FIG. 12 is a drawing illustrating a relationship between dot variation and a drive current before spatial frequency control is applied.
Figure 13:
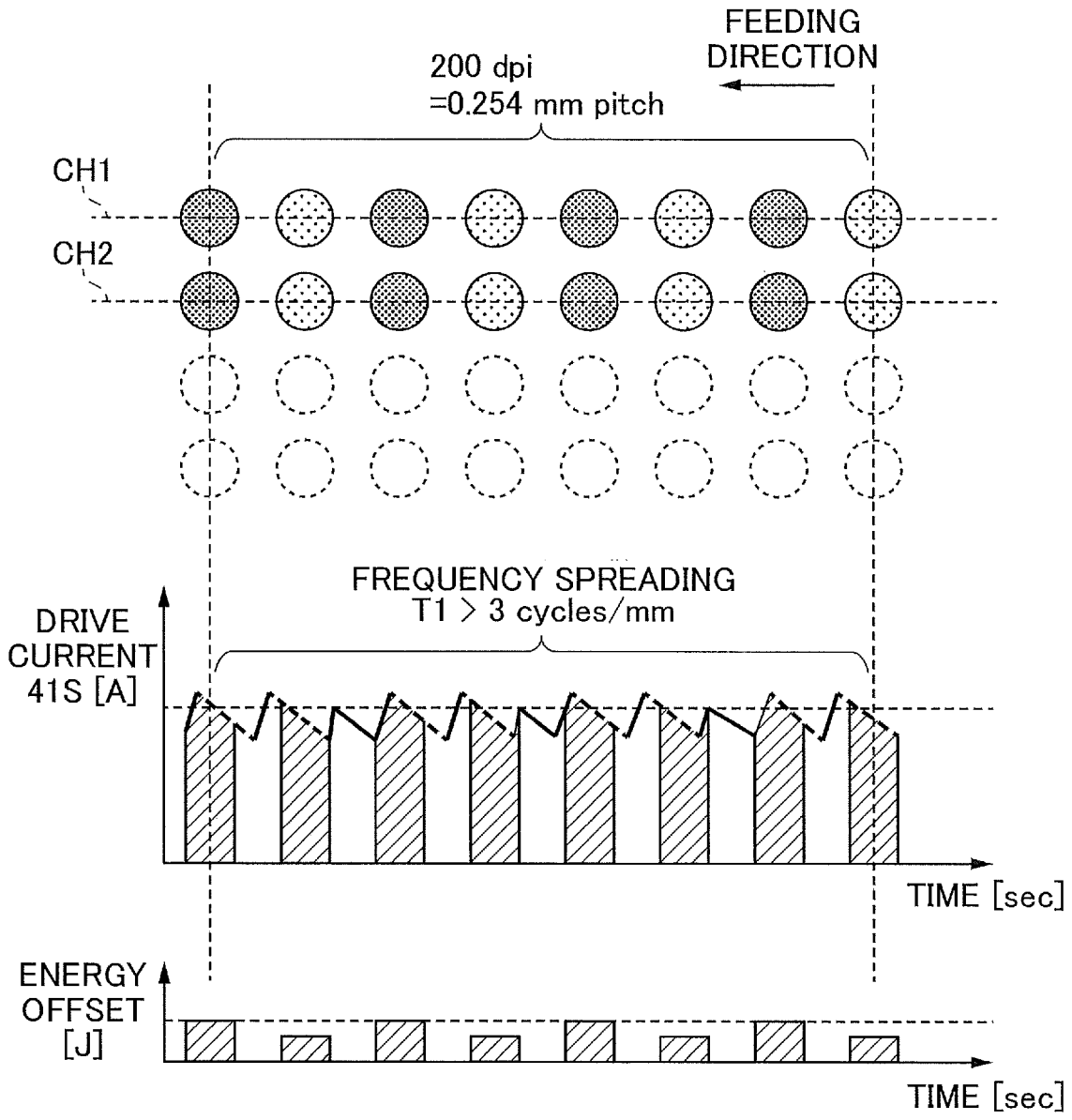
FIG. 13 is a drawing illustrating a relationship between dot variation and a drive current after spatial frequency control is applied.

FIG. 12 is a drawing illustrating a relationship between the dot variation before the spatial frequency control is applied and the drive current 41S. FIG. 13 is a drawing illustrating a relationship between the dot variation after the spatial frequency control is applied and the drive current 41S.

FIG. 12 illustrates an example where the dot density variation is 2.6 [cycles/mm]. When the conveying speed v is 5,000 the mm/s, this corresponds to about 13.3 [kHz]. The noise may occur in a circuit operation under general operating conditions where the switching frequency fsw is 53.3 [kHz] and the pixel frequency fdot is 40 [kHz] (to avoid the audible frequency range, both of the pixel frequency fdot and the switching frequency fsw are preferably greater than or equal to 40 [kHz]).

As described above, the dot density variation (energy offset variation) in the figure occurs based on a mechanism in which a different frequency different from the frequencies of original signals is generated when different frequency signals are mixed. This is expressed by a formula below.

Energy offset variation frequency [*Hz*]=pixel frequency *fdot* [*Hz*]±switching frequency *fsw*[*Hz*]

When the recording target is scanned at a conveying speed v [mm/s] (when information is recorded while conveying the recording target), the dot density variation cycle [cycles/mm] is expressed by a formula below and corresponds to the cycle T1 of the sum frequency and the difference frequency described above.

Dot density variation cycle [cycles/mm]=(pixel frequency *fdot*±switching frequency *fsw*)[*Hz*]/conveying speed *v* [mm/s]

That is, the dot density variation cycle tends to increase when the switching frequency fsw and pixel frequency fdot are close to each other.

In the first embodiment, as indicated by dotted lines in the graph of the drive current 41S in FIG. 12 and FIG. 13, the dot density variation cycle T1 is made greater than 3 [cycles/mm] and the switching frequency fsw is spread by combining the switching frequency fsw with a different frequency component. This reduces the density unevenness of dots perceived when viewing a printed image and suppresses the reduction in the quality of the printed image due to switching noise.

Figure 14:
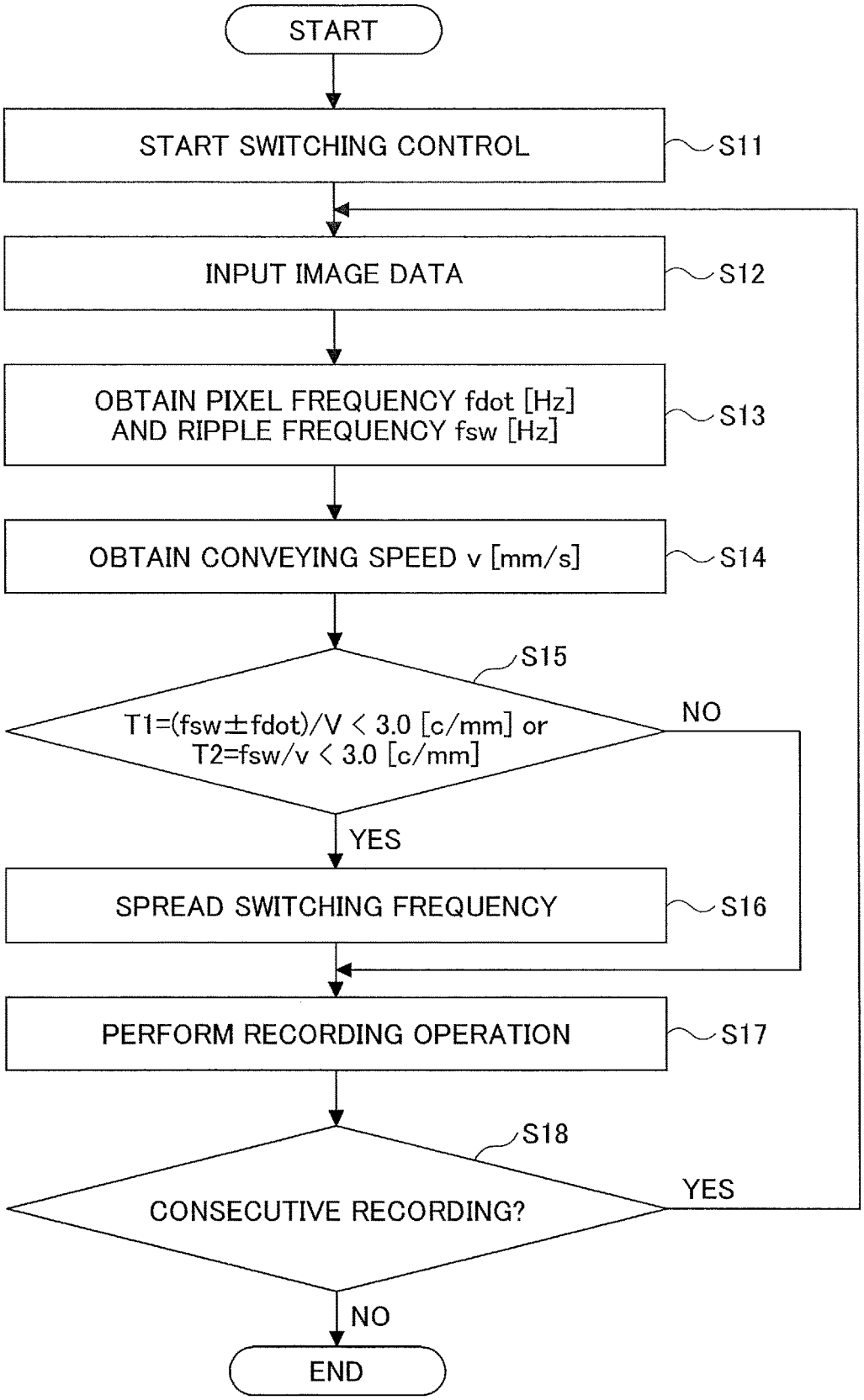
FIG. 14 is a flowchart illustrating a spatial frequency control process according to the first embodiment.

FIG. 14 is a flowchart illustrating a spatial frequency control process according to the first embodiment. Steps in the flowchart of FIG. 14 are performed by the controller 46.

At step S11, the circuit of the driver 45A is started, and switching control is started so that the driver 45A can output a current at any timing.

At step S12, an IF signal (image information) for forming an image is input from the image information output unit 47.

At step S13, the pixel frequency fdot [Hz] is obtained from the image information, and the ripple frequency fsw [Hz] is obtained from the circuit operation.

At step S14, the conveying speed v [m/s] is obtained from print conditions.

At step S15, influence on image quality is determined based on the dot density variation cycle (the sum and difference frequencies T1) [cycles/mm]=(fsw±fdot) [Hz]/v [mm/s] (here, it is assumed that the dot density variation cycle is less than 3 [cycles/mm] and the influence on image quality is large). It is also determined that the influence on image quality is large when "ripple cycle T2 [cycles/mm]=fsw [Hz]/v [mm/s]<3.0" is satisfied.

When it is determined that the influence on image quality is large (YES at step S15), the switching frequency fsw is spread at step S16. It is difficult to quantify the spreading amount because the spreading amount depends on subjective evaluation by humans. In a general noise spreading technology (e.g., SSCG), several percent of the basic cycle is spread. However, to spread using 0 to 3 [cycles/mm] to the maximum, i.e., 1.5±1.5 [cycles/mm] (±100%), the related-art SSCG is insufficient. The spreading method of the present embodiment is described later with reference to FIG. 16 and FIG. 17. As a result of step S16, the peaks of the sum and difference frequencies T1 and the peak of the ripple cycle T2 described with reference to FIG. 8B are spread, and the density unevenness is reduced.

At step S17, recording is performed. At step S18, the user determines whether to perform consecutive recording.

When it is determined to perform consecutive recording at step S18, the process returns to step S12; and when it is determined to not perform consecutive recording at step S18, the process is terminated.

Figure 15:
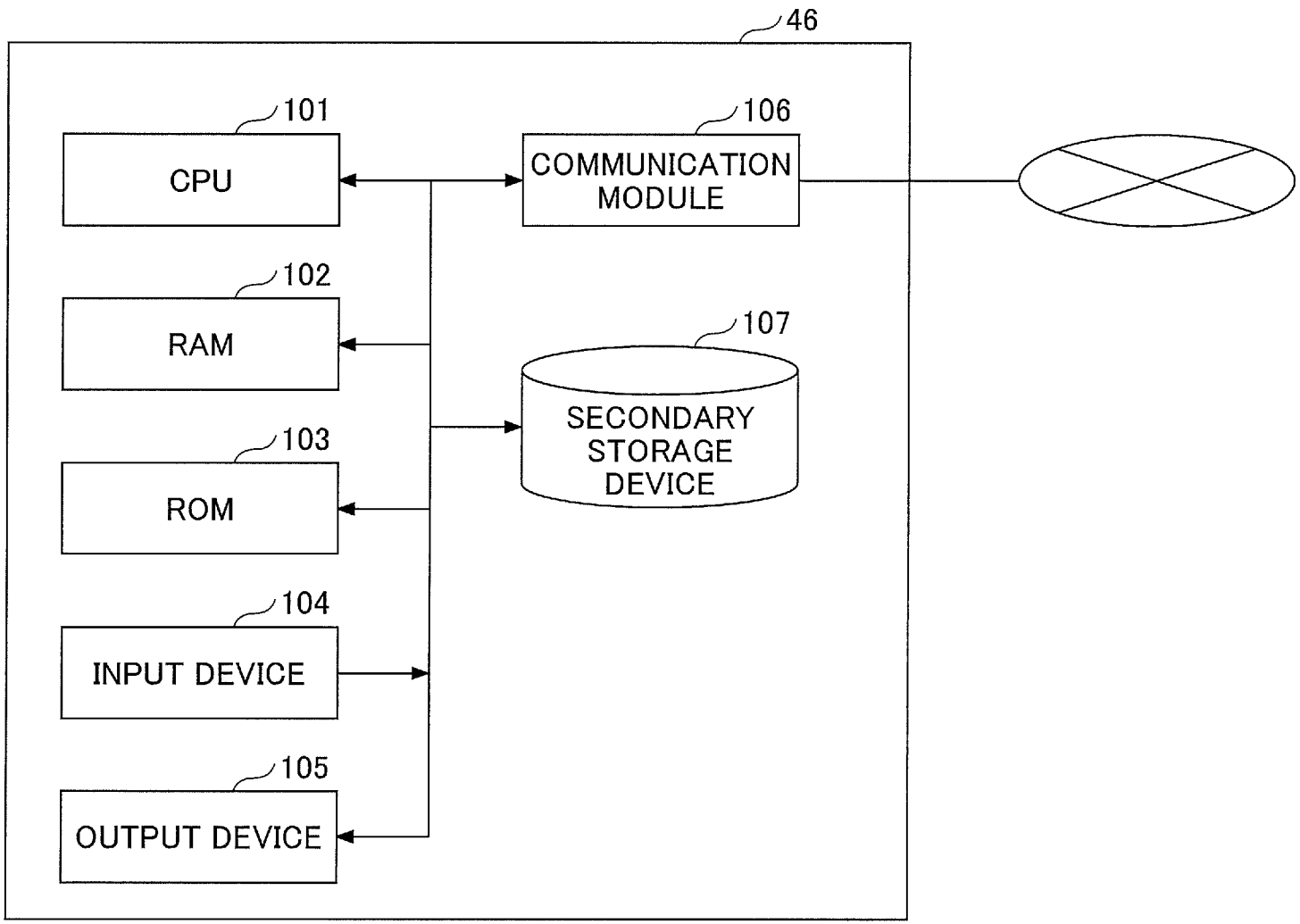
FIG. 15 is a drawing illustrating an example of a hardware configuration of a controller.

FIG. 15 illustrates an example of a hardware configuration of the controller 46. As illustrated in FIG. 15, the controller 46 may be physically implemented as a computer system that includes a central processing unit (CPU) 101, main memories such as a random access memory (RAM) 102 and a read only memory (ROM) 103, an input device 104 such as a keyboard and a mouse, an output device 105 such as a display or a touch panel, a communication module 106 that is a data transmission/reception device such as a network card, and a secondary storage device 107 such as a hard disk.

The functions of the controller 46 described above may be implemented by loading predetermined computer software (output control program) onto hardware components such as the CPU 101 and the RAM 102, causing the communication module 106, the input device 104, and the output device 105 to operate under the control of the CPU 101, and reading and writing data from and into the RAM 102 and the secondary storage device 107.

The output control program of the present embodiment is stored in, for example, a storage device in a computer. A part or the entirety of the output control program may be transmitted via a transmission medium such as a communication line, received by, for example, a communication module of a computer, and recorded (installed). Also, a part or the entirety of the output control program may be stored in a portable storage medium such as a CD-ROM, a DVD-ROM, or a flash memory and then recorded (or installed) in the computer.

Figure 16:
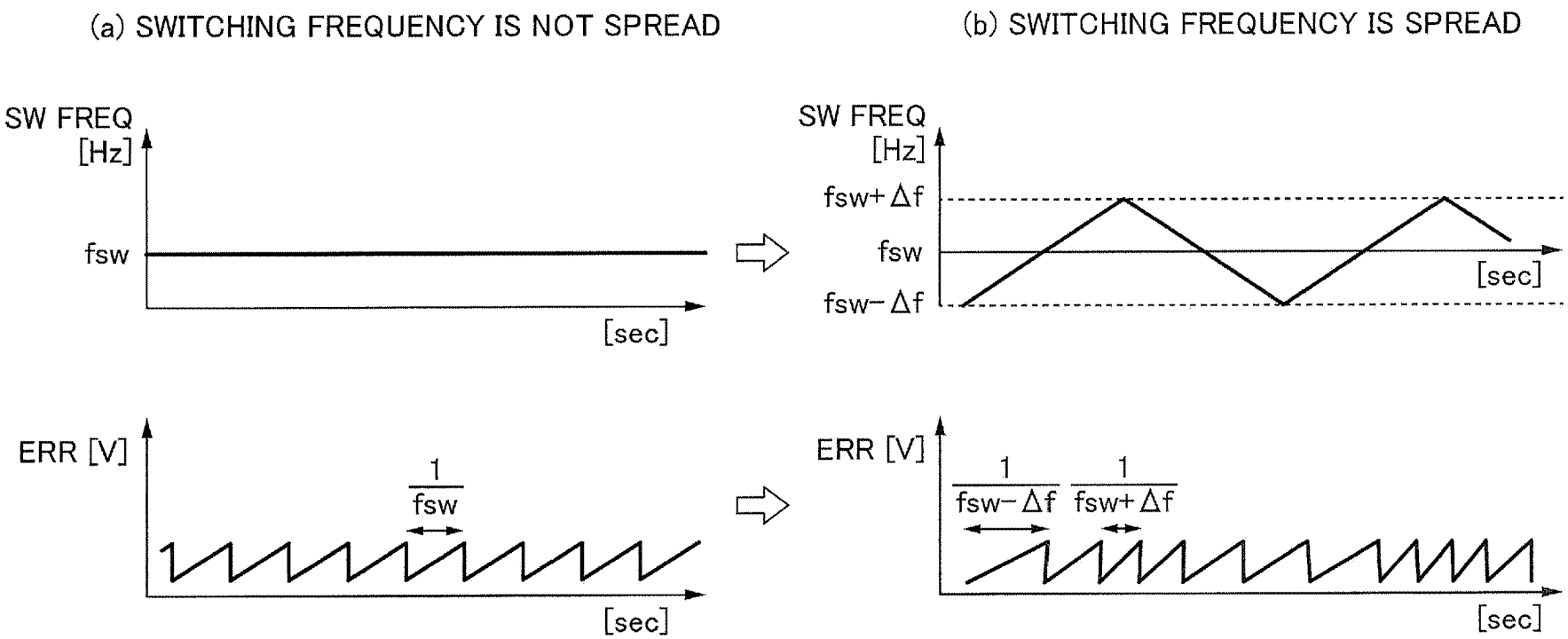
FIG. 16 is a drawing illustrating an example of processing of an ERR signal for switching frequency spreading.
Figure 17:
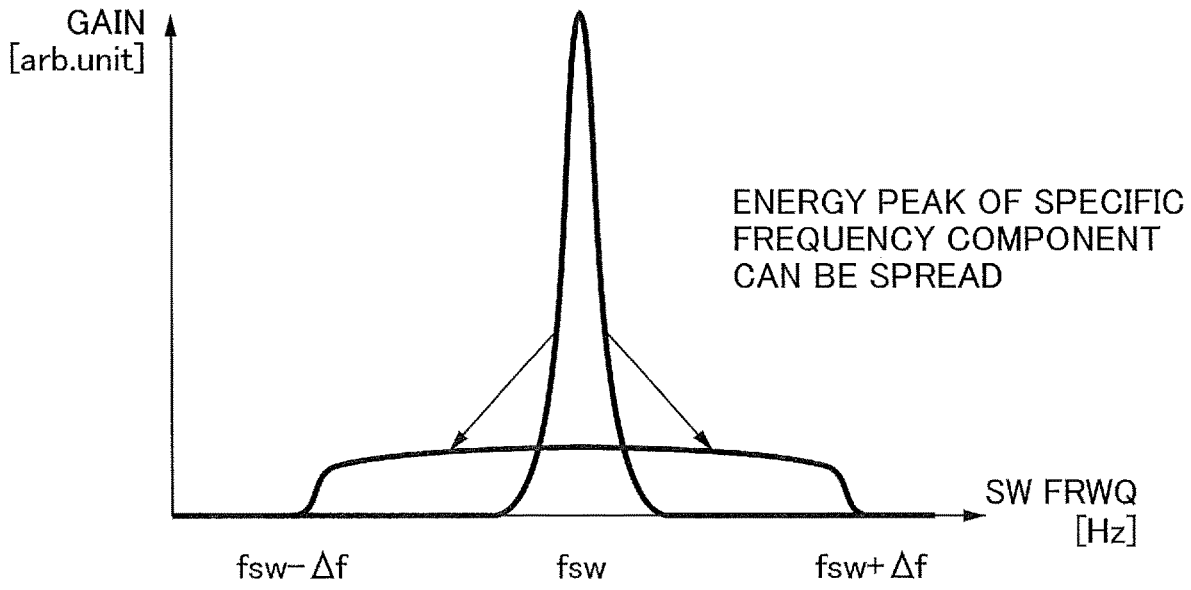
FIG. 17 is a graph illustrating an effect of switching frequency spreading achieved by the processing of the ERR signal illustrated in FIG. 16.

The frequency spreading process of step S16 in the flowchart of FIG. 14 is described in more detail with reference to FIG. 16 and FIG. 17. FIG. 16 is a drawing illustrating an example of processing of an ERR signal for switching frequency spreading. FIG. 17 is a graph illustrating an effect of switching frequency spreading achieved by the processing of the ERR signal illustrated in FIG. 16.

As illustrated in FIG. 16(*a*), when the switching frequency is not spread, the error signal ERR has a sawtooth waveform with a cycle of 1/fsw, and the switching frequency is constant at a predetermined value fsw. On the other hand, as illustrated in FIG. 16(*b*), when the switching frequency is spread, the error signal ERR has a waveform that includes three types of cycles and is formed by combining a sawtooth waveform with a cycle of 1/fsw, a sawtooth waveform with a cycle of 1/(fsw−Δf), and a sawtooth waveform with a cycle of 1/(fsw+Δf). As a result, the switching frequency becomes a triangular wave that transitions between fsw−Δf and fsw+Δf.

Thus, as illustrated in FIG. 17, spreading the switching frequency makes it possible to spread the energy peak of the specific frequency component fsw between fsw−Δf and fsw+Δf. The frequency spreading process exemplified in FIG. 16 and FIG. 17 may be implemented by, for example, an electric circuit described in Japanese Unexamined Patent Application Publication No. 2006-340333.

In the switching frequency spreading process, the spreading is preferably performed in a range greater than or equal to ±10% with respect to the average frequency fsw. The switching frequency is preferably spread as uniformly as possible and as widely as possible within the dot density variation cycle (0-3 [cycles/mm]).

Second Embodiment

Figure 18:
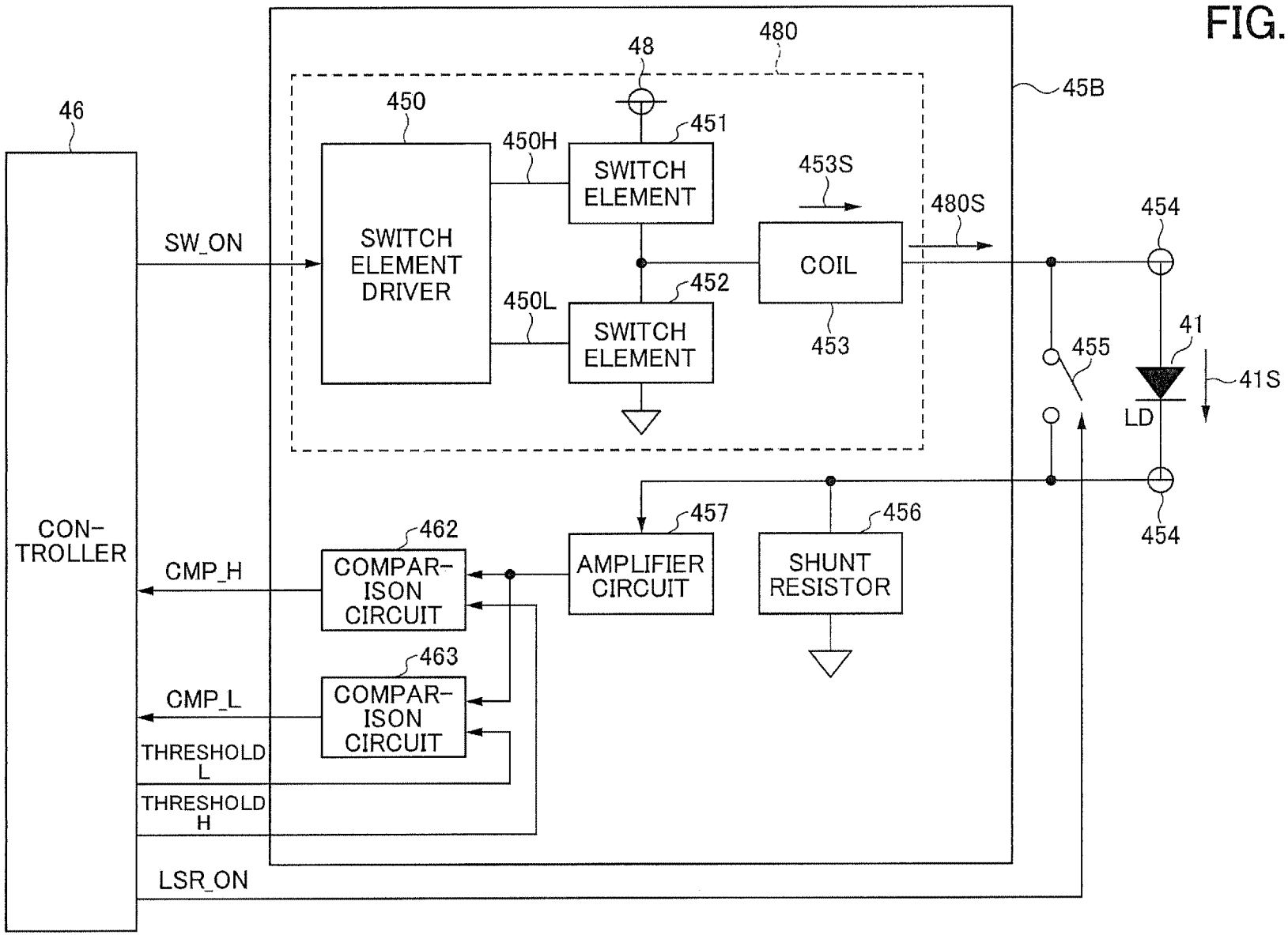
FIG. 18 is a drawing illustrating an example of a configuration of a switching driver according to a second embodiment.
Figure 19:
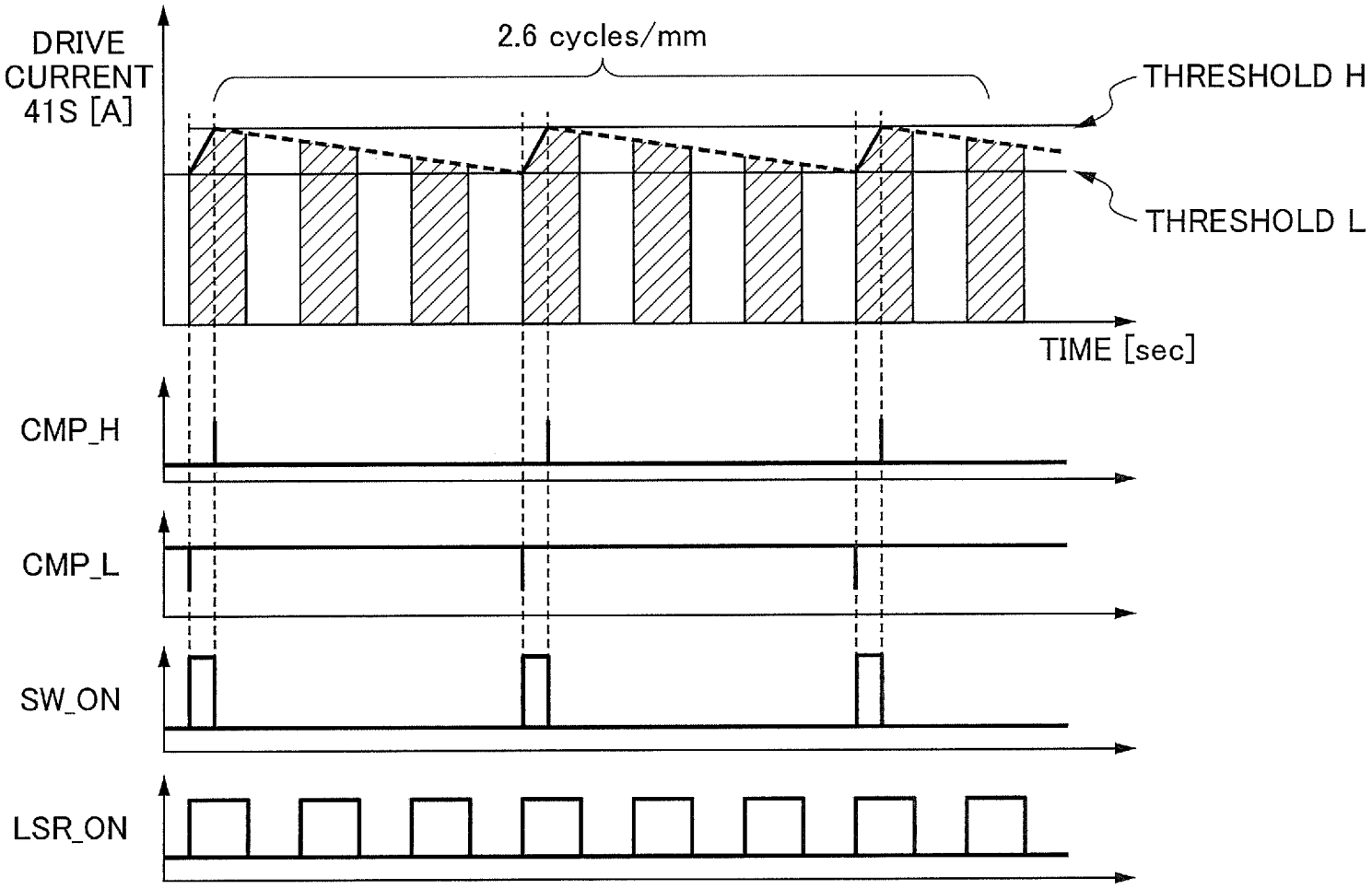
FIG. 19 is a timing chart of driver operations before spatial frequency control is applied.

A second embodiment is described with reference to FIGS. 18 through 22. FIG. 18 is a drawing illustrating an example of a configuration of a switching driver 45B according to the second embodiment. FIG. 19 is a timing chart of driver operations before spatial frequency control is applied. The circuit configuration of the driver 45B of the second embodiment is based on hysteresis control; and as illustrated in FIG. 19, a switch element is turned on and off so that the drive current is kept between a higher threshold H and a lower threshold L.

As illustrated in FIG. 18, the driver 45B includes two comparison circuits 462 and 463. The comparison circuit 462 compares an amplified voltage output from the amplifier circuit 457 with the higher threshold H output from the controller 46, and outputs a determination signal CMP_H indicating the comparison result to the controller 46. The comparison circuit 463 compares the amplified voltage output from the amplifier circuit 457 with the lower threshold L output from the controller 46, and outputs a determination signal CMP_L indicating the comparison result to the controller 46. As illustrated in FIG. 19, the controller 46 turns on a SW_ON signal when the determination signal CMP_L is turned off, turns off the SW_ON signal when the determination signal CMP_H is turned on, and outputs the SW_ON signal to the switching circuit 480. The switching circuit 480 controls the output current 480S according to the SW_ON signal.

The driver 45B of the second embodiment has an advantage that because the feedback response is not limited by the switching cycle, an output can be immediately obtained regardless of a load and the response speed is high. Also, because the switching cycle is not fixed and the switching frequency fsw is spread by its fundamental structure, the present embodiment can be easily applied to the driver 45B.

Figure 20:
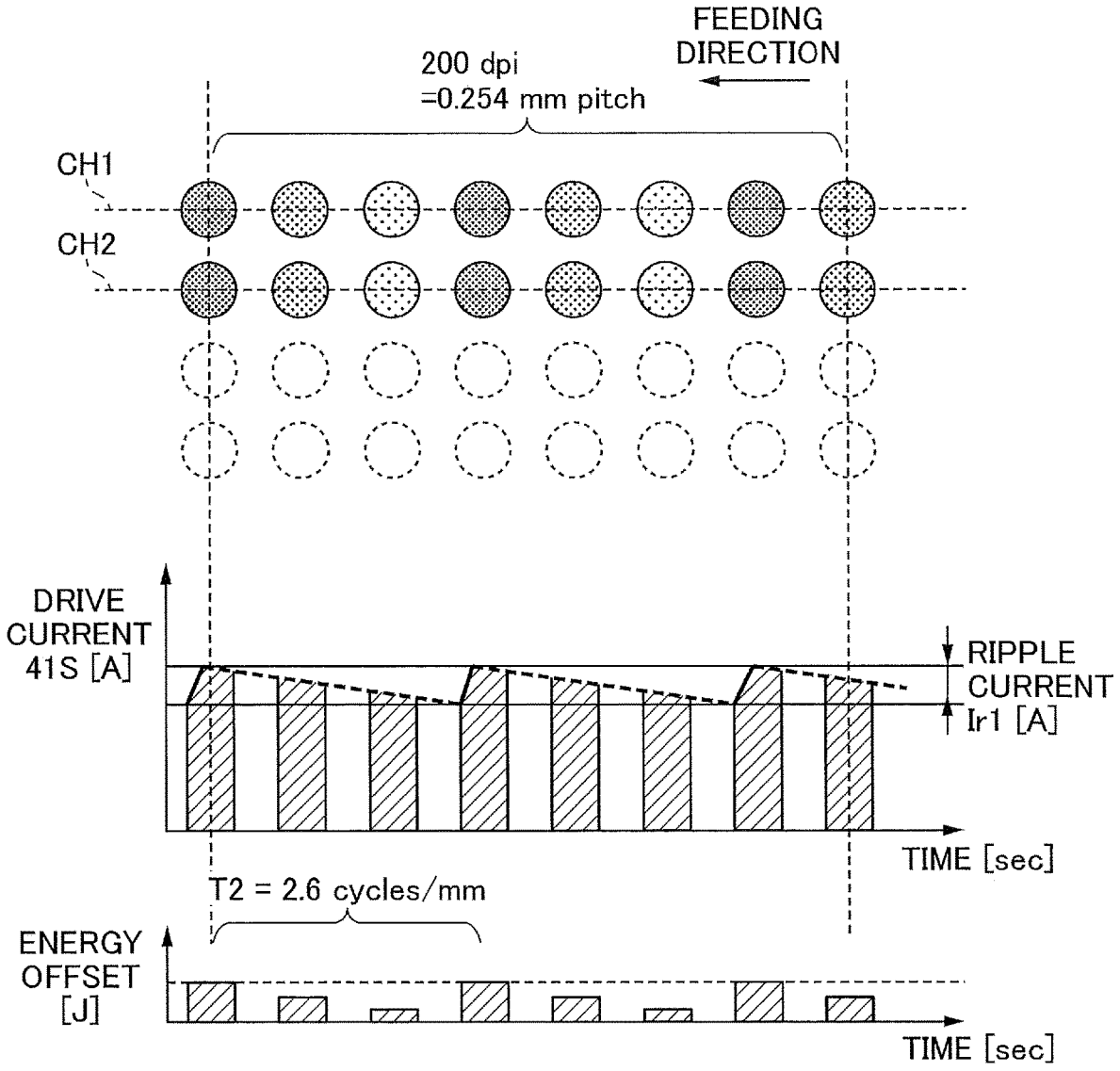
FIG. 20 is a drawing illustrating a relationship between dot variation and a drive current before spatial frequency control is applied.
Figure 21:
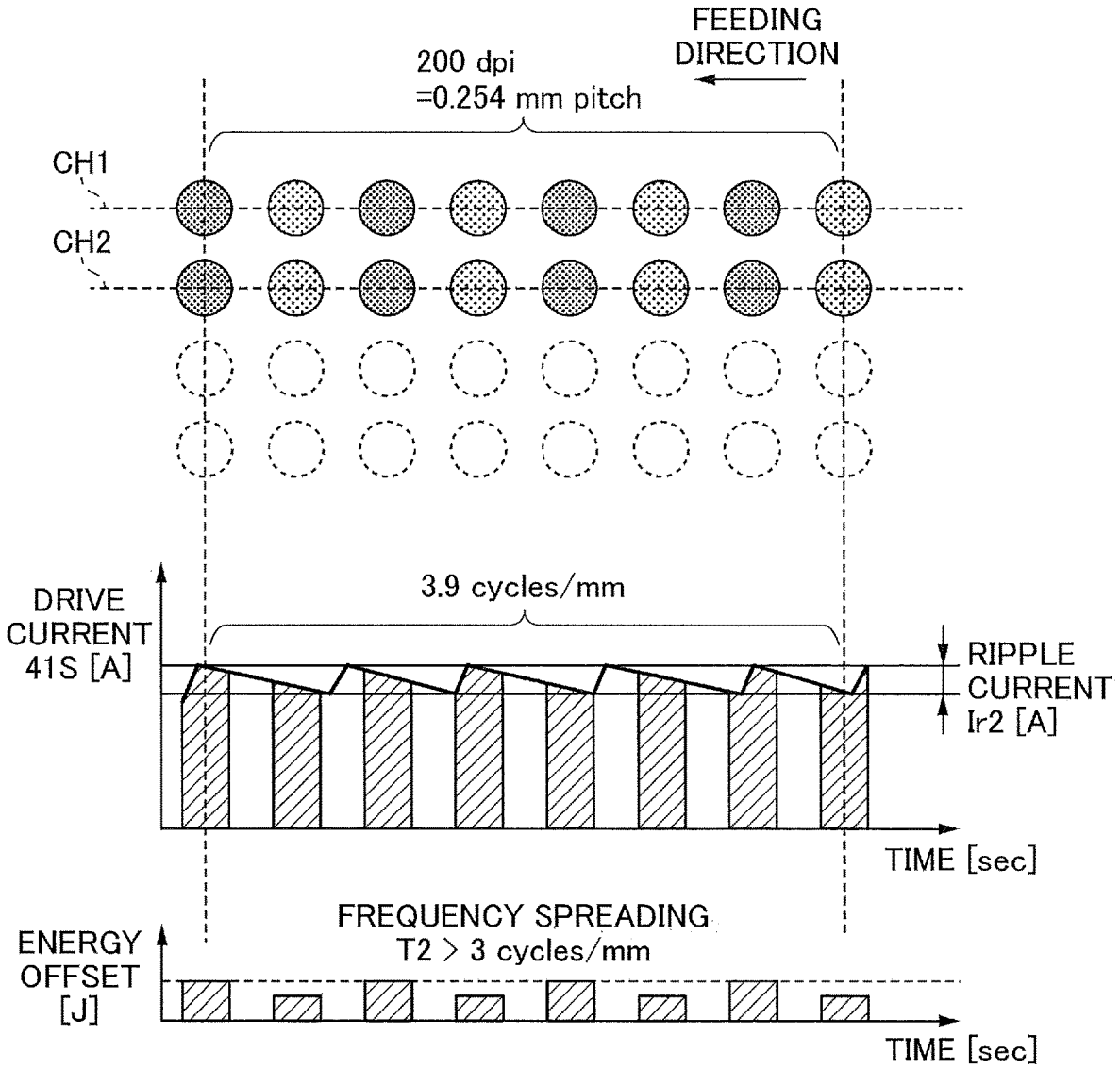
FIG. 21 is a drawing illustrating a relationship between dot variation and a drive current after spatial frequency control is applied.

FIG. 20 is a drawing illustrating a relationship between dot variation and a drive current before spatial frequency control is applied. FIG. 21 is a drawing illustrating a relationship between dot variation and a drive current after spatial frequency control is applied. Here, only the switching frequency fsw [Hz] and the conveying speed v [mm/s] influence the dot density variation cycle. The dot density variation cycle [cycles/mm] in the figures is expressed by a formula below and corresponds to the ripple cycle T2 described above.

Dot density variation cycle [cycles/mm ]=switching frequency *fsw*[*Hz*]/conveying speed *v*[mm/s]

Because the rise and fall of the ripple current are linked with the energy offset, the spatial frequency between 0 and 3 cycles/mm causing dot density unevenness easily perceivable as image unevenness can be avoided by changing the switching frequency fsw along with the conveying speed v. Depending on the system configuration, the switching frequency fsw needs to be changed such that a frequency band that is severe to noise is avoided. In the second embodiment, as indicated by dotted lines in the graph of the drive current 41S in FIG. 20 and FIG. 21, the ripple cycle T2 is changed to the high frequency side (3.9 [cycles/mm]) to a value greater than or equal to a predetermined cycle (e.g., 3 [cycles/ram]) to reduce the density unevenness of dots perceived when viewing a printed image and suppress the reduction in the quality of the printed image due to switching noise.

Figure 22:
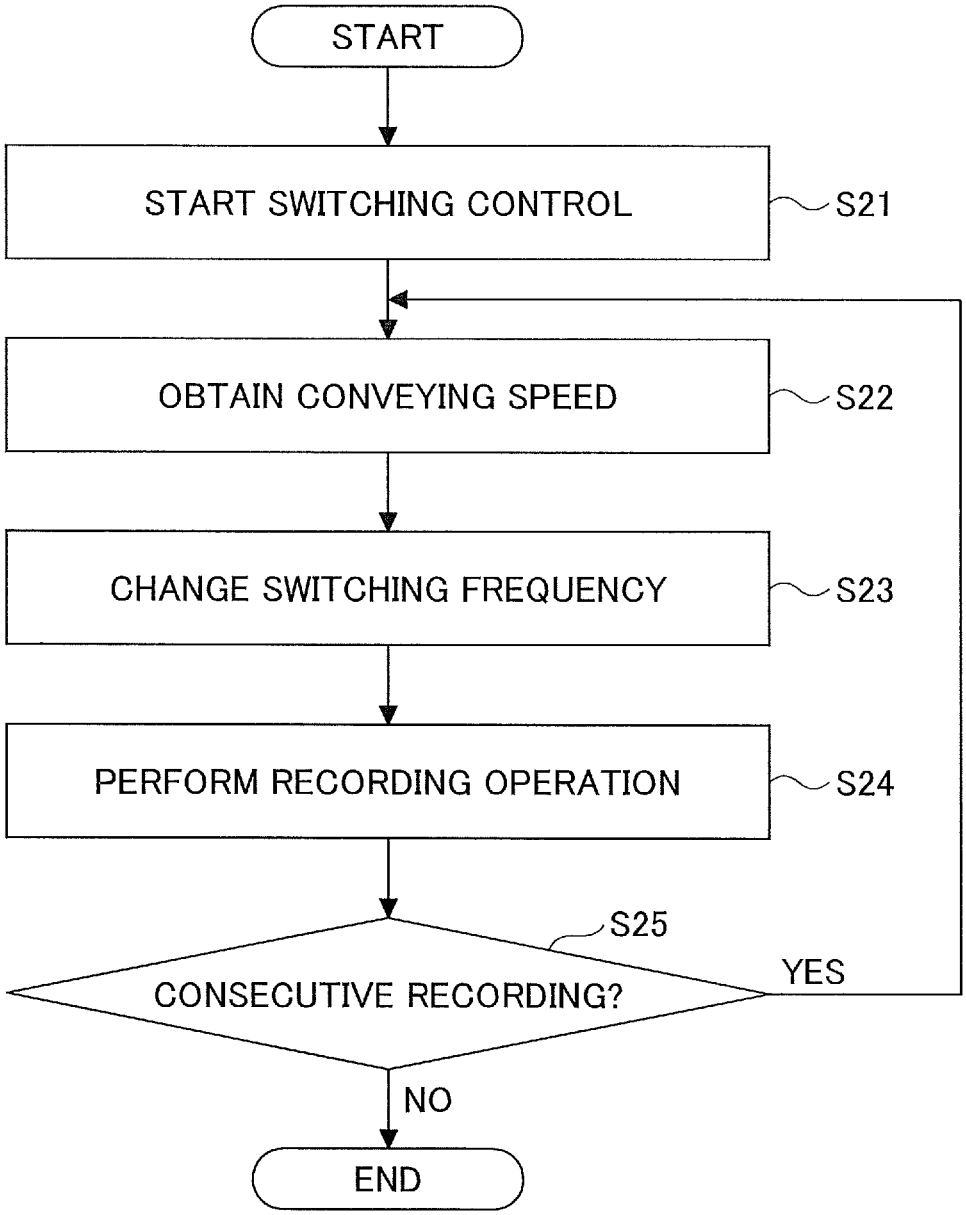
FIG. 22 is a flowchart illustrating a spatial frequency control process according to the second embodiment.

FIG. 22 is a flowchart illustrating a spatial frequency control process according to the second embodiment. Steps in the flowchart of FIG. 22 are performed by the controller 46.

At step S21, the circuit of the driver 45B is started, and switching control is started so that the driver 45B can output a current at any timing.

At step S22, the conveying speed v [m/s] is obtained from print conditions.

At step S23, the switching frequency fsw is changed to the high frequency side according to the conveying speed v to change the dot density variation cycle (ripple cycle T2) to the high frequency side. Specific changing methods include reducing the ripple width between the threshold H and the threshold L illustrated in FIG. 21 and increasing the frequency of the ERR signal illustrated in FIG. 11.

At step S24, a recording operation is performed. At step S25, the user determines whether to perform consecutive recording.

When it is determined to perform consecutive recording at step S25, the process returns to step S22; and when it is determined to not perform consecutive recording at step S25, the process is terminated.

The spatial frequency control by the driver 45B of the second embodiment has excellent compatibility with related-art technologies such as a PWM control method, a PFM control method, and a hysteresis control method, and can be easily implemented. Although changing the switching frequency is a widely-used method for EMC, the second embodiment is unique in that the switching frequency is changed based on the influence on image quality.

An image recording apparatus, an output control method, and a storage medium according to embodiments of the present invention are described above. However, the present invention is not limited to the above-described embodiments. Technologies obtained by a person skilled in the art by applying design changes to the above embodiments are also included in the scope of the present invention as long as those technologies include the features described in the above embodiments. Various elements in the above embodiments and the arrangement, conditions, and shapes of those elements are not limited to the examples described in the embodiments and may be changed as necessary. The combinations of elements in the above-described embodiments may be changed as long as the changed combinations are technically inconsistent.

In the above embodiments, recording is performed by conveying the container C (recording target) in one direction with the conveyor apparatus 10 while the recording apparatus 14 for emitting laser beams is kept stationary. Alternatively, the recording target may be kept stationary and the recording apparatus 14 may be moved to perform recording. That is, the image recording system 100 may include a moving part such as the conveyor apparatus 10 that moves one of a recording target on which an image is to be recorded with a light beam from a light source and a light emitting position at which the light beam is emitted relative to another one of the recording target and the light emitting position. In this case, the conveying speed v may be referred to as a "relative moving speed v".

In the above embodiments, a fiber-array recording apparatus including multiple light sources (laser devices 41) is used as the recording apparatus 14, and a recording target is moved by the conveyor apparatus 10 (moving part) while the light sources are kept stationary. However, the method of recording an image on a recording target is not limited to this example. For example, a configuration where a recording target is kept stationary and a light source is moved may be employed. In such a configuration, for example, an image may be recorded on a recording target by raster-scanning the recording target with a single light source.

An aspect of this disclosure makes it possible to suppress reduction in the quality of an image recorded on a recording target due to switching noise in an image recording apparatus including a switching driver circuit.

What is claimed is:

1. An image recording apparatus, comprising:

a light source;

a switching drive circuit configured to control an electric current for causing the light source to emit a light beam;

a moving part configured to move one of a recording target on which an image is to be recorded by the light beam and a light emitting position at which the light beam is emitted relative to another one of the recording target and the light emitting position; and a controller configured to control a light emission timing of the light source and a relative moving speed of the moving part based on image information, wherein the switching drive circuit includes a switching circuit configured to turn on and off a switching element; and the controller is configured to change a switching frequency of the switching element according to at least one of the light emission timing and the relative moving speed, said switching frequency being a frequency of noise generated by the switching element during a switching operation of the switching circuit.

2. The image recording apparatus as claimed in claim 1, wherein the controller is configured to spread the switching frequency when a ripple cycle resulting from an operation of the switching circuit or a cycle that is attributed from a sum frequency and a difference frequency that are generated when a pixel frequency corresponding to a frequency of the light emission timing overlaps the switching frequency, become less than a predetermined cycle.

3. The image recording apparatus as claimed in claim 1, wherein the controller is configured to change the switching frequency to a high frequency side so that a ripple cycle resulting from an operation of the switching circuit becomes greater than or equal to a predetermined cycle, the ripple cycle being calculated by dividing the switching frequency by the relative moving speed.

4. A method performed by an image recording apparatus that includes a light source, a switching drive circuit configured to control an electric current for causing the light source to emit a light beam, a moving part configured, to move one of a recording target on which an image is to be recorded by the light beam and a light emitting position at which the light beam is emitted relative to another one of the recording target and the light emitting position, and a controller configured to control a light emission timing of the light source and a relative moving speed of the moving part based on image information, the switching drive circuit including a switching circuit configured to turn on and off a switching element, the method comprising:

changing, by the controller, a switching frequency of the switching element according to at least one of the light emission timing and the relative moving speed, said switching frequency being a frequency of noise generated by the switching element during a switching operation of the switching circuit; and controlling, by the controller, the switching drive circuit based on a changed switching frequency.

5. A non-transitory computer-readable storage medium storing a program for causing an image recording apparatus to execute a process, the image recording apparatus including a light source, a switching drive circuit configured to control an electric current for causing the light source to emit a light beam, a moving part configured to move one of a recording target on which an image is to be recorded by the light beam and a light emitting position at which the light beam is emitted relative to another one of the recording target and the light emitting position, and a controller configured to control a light emission timing of the light source and a relative moving speed of the moving part based on image information, the switching drive circuit including a switching circuit configured to turn on and off a switching element, wherein the process includes changing a switching frequency of the switching element according to at least one of the light emission timing and the relative moving speed, said switching frequency being a frequency of noise generated by the switching element during a switching operation of the switching circuit; and controlling the switching drive circuit based on a changed switching frequency.

* * * * *